US007177559B2

(12) United States Patent
Inoue et al.

(10) Patent No.: US 7,177,559 B2
(45) Date of Patent: Feb. 13, 2007

(54) IMAGE FORMING APPARATUS WITH TEMPERATURE CONTROL

(75) Inventors: Hiroyuki Inoue, Tokyo (JP); Takemasa Ishikuro, Tokyo (JP); Takeshi Asaba, Tokyo (JP)

(73) Assignee: Oki Data Corporation, Tokyo (JP)

( * ) Notice: Subject to any disclaimer, the term of this patent is extended or adjusted under 35 U.S.C. 154(b) by 205 days.

(21) Appl. No.: 10/827,372

(22) Filed: Apr. 20, 2004

(65) Prior Publication Data

US 2004/0247335 A1 Dec. 9, 2004

(30) Foreign Application Priority Data

Apr. 24, 2003 (JP) ..... 2003-119949

(51) Int. Cl.
*G03G 15/00* (2006.01)

(52) U.S. Cl. ..... 399/44; 399/94

(58) Field of Classification Search ..... None
See application file for complete search history.

(56) References Cited

U.S. PATENT DOCUMENTS

| | | | | |
|---|---|---|---|---|
| 5,832,332 | A * | 11/1998 | Sugiura | 399/44 |
| 5,893,009 | A * | 4/1999 | Yamada | 399/44 |
| 5,907,741 | A * | 5/1999 | Matsuzawa et al. | 399/44 |
| 6,219,496 | B1 * | 4/2001 | Kojima et al. | 399/43 |
| 6,493,521 | B2 * | 12/2002 | Miyamoto et al. | 399/44 |
| 6,542,703 | B1 * | 4/2003 | Jung | 399/44 |
| 6,694,108 | B2 * | 2/2004 | Hirose et al. | 399/44 |

FOREIGN PATENT DOCUMENTS

| | | | |
|---|---|---|---|
| JP | 04139479 | A * | 5/1992 |
| JP | 08044435 | A * | 2/1996 |
| JP | 09171275 | A * | 6/1997 |
| JP | 10133517 | A * | 5/1998 |
| JP | 2000-019807 | | 1/2000 |
| JP | 2000347531 | A * | 12/2000 |
| JP | 2002-040822 | | 2/2002 |

* cited by examiner

*Primary Examiner*—Robert Beatty
(74) *Attorney, Agent, or Firm*—Rabin & Berdo, PC

(57) ABSTRACT

An image forming section forms a visible image on a charged surface of an image bearing body. A transfer section transfers the visible image onto a recording medium. A fixing unit fixes the visible image on the recording medium. A temperature detecting section outputs a signal indicative of a temperature of the image bearing body. A controller performs a cooling operation in which the temperature of the image bearing body is lowered when the signal is higher than a first predetermined value. When the controller performs the cooling operation, the controller turns on and off the heater of the fixing unit with a first duty cycle. When the controller does not perform the cooling operation, the controller turns on and off the heater of the fixing unit with a second duty cycle higher than the first duty cycle. During the cooling operation, the controller may drive the medium-transporting mechanism to rotate in an idling mode in which no printing is performed.

20 Claims, 18 Drawing Sheets

| TEMPERATURE (℃) | DETECTED VOLTAGE [V] | RESISTANCE [KΩ] |
|---|---|---|
| 0 | 0.791 | 27.1 |
| 1 | 0.821 | 26.0 |
| ⋮ | ⋮ | ⋮ |
| 10 | 1.113 | 17.8 |
| ⋮ | ⋮ | ⋮ |
| 20 | 1.487 | 12.0 |
| ⋮ | ⋮ | ⋮ |
| 50 | 2.712 | 4.30 |
| 60 | 3.079 | 3.18 |

IMAGE FORMING APPARATUS WITH TEMPERATURE CONTROL

BACKGROUND OF THE INVENTION

1. Field of the Invention

The present invention relates to an image-forming apparatus and more particularly to an image forming apparatus in which image bearing bodies are cooled.

2. Description of the Related Art

A conventional image-forming apparatus such as a color printer, a copying machine, and a facsimile machine is provided with printing mechanisms for forming black, yellow, magenta, and cyan images. One such image forming apparatus is disclosed in Japanese Patent Laid Open No. 2000-19807. Each printing mechanism takes the form of an ID (image drum), which includes an image forming section that forms a toner image of a corresponding color and a transferring unit that transfers the toner image of the corresponding color onto a print medium in registration. A toner cartridge holds toner of a corresponding color and is detachably mounted to the image forming section. The toner is supplied into the image forming section through an opening formed at the bottom of the toner cartridge.

The recording medium is fed from a paper cassette on a sheet-by-sheet basis into a transport path. Then, the recording medium is attracted electrostatically to a transport belt. The transport belt runs through the respective image forming sections in sequence, so that toner images of the respective colors are transferred onto the recording medium in registration with one another. Then, the recording medium leaves the transport belt and subsequently enters a fixing unit where the toner images on the recording medium are fused into a full color permanent image.

With the aforementioned conventional image forming apparatus, poor print quality results from changes in environmental conditions and increased interior temperature of the apparatus due to continuous printing of a large number of pages.

Extremely increased ambient temperatures causes the fluidity of toner in the image forming section to decrease, so that toner become difficult to be transported by a developing roller in a developing unit. As a result, the toner continues to be agitated to agglomerate within the developing unit. This causes degradation of the density, gamma characteristic, and smoothness of continuously changing gradation of halftone images that should be expressed by critical shades of color.

SUMMARY OF THE INVENTION

An object of the present invention is to solve the problems of the aforementioned conventional image forming apparatus.

Another object of the invention is to minimize temperature increase in the apparatus, thereby preventing deterioration of print quality.

An image forming apparatus includes an image forming section, a transport belt, a fixing unit, a temperature detecting section, and a controller.

The image forming section forms an electrostatic latent image on a charged surface of an image bearing body. The latent image is developed with toner into a visible image. The transfer section transfers the visible image onto a recording medium. The fixing unit fixes the visible image on the recording medium. The temperature detecting section outputs a signal indicative of a temperature of a predetermined part of the image forming apparatus. The controller performs a cooling operation in which the temperature of the image bearing body is lowered when the signal is higher than a first predetermined value.

During the cooling operation, the controller controllably energizes a heater of the fixing unit for a predetermined fixing temperature.

The controller stops energizing the heater of the fixing unit during the cooling operation.

When the controller performs the cooling operation, the controller turns on and off the heater of said fixing unit with a first duty cycle. When the controller does not perform the cooling operation, the controller turns on and off the heater of said fixing unit with a second duty cycle higher than the first duty cycle During the cooling operation, the controller drives a medium-transporting mechanism of the fixing unit to rotate in an idling mode in which no printing is performed.

The controller causes the medium-transporting mechanism to rotate at a higher speed in the cooling operation than in a normal printing operation.

The image forming apparatus further includes a belt adapted to rotate in contact with the image bearing body. During the cooling operation, the controller drives the belt and the image bearing body to rotate in an idling mode in which no printing is performed.

The controller drives the belt and the image bearing body to rotate at a higher speed in the cooling operation than in a normal printing operation.

The temperature detecting section detects a temperature of the belt. The signal indicating substantially the temperature of the image bearing body.

The image forming section is movable between an operative position at which the image bearing body is in contact with the belt and a non-operative position at which the image bearing body is not in contact with the belt. The controller causes the image forming section to move to the non-operative position when the cooling operation is activated.

During the cooling operation, the controller causes air to flow through a gap between the image forming section and the belt.

The image forming apparatus further includes a medium turning mechanism in which when the recording medium exits said fixing unit, the recording medium is turned over so that its under side becomes its top side. During the cooling section, said controller causes the recording medium to pass through the medium turning mechanism in such a way that a same page of the recording medium passes under said image forming section a plurality of times but is not printed on.

The page of the recording medium is printed upon a print command subsequent to the cooling operation.

The page of the recording medium is discharged from the apparatus after the cooling operation.

The controller performs the cooling operation when the signal exceeds a first predetermined value. The threshold temperature is adapted to be set to a desired value.

Before each page of the recording medium is printed on, the controller determines whether the cooling operation should be performed.

Upon receiving a print job, the controller determines whether the cooling operation should be performed.

The controller terminates the cooling operation after the cooling operation is performed for a predetermined length of time.

When the signal is below a second predetermined value, the controller terminates the cooling operation.

The temperature detecting section is located in the vicinity of the image bearing body to detect a temperature of an atmosphere surrounding the image bearing body, the signal indicating substantially the temperature of the image bearing body.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

Embodiments of the invention will be described in detail with reference to the accompanying drawings.

While a description will be given of a printer as an image forming apparatus that forms and prints color images, the present invention may also be applied to copying machines, facsimile machines, and the like.

First Embodiment

{Construction}

Figure 1:
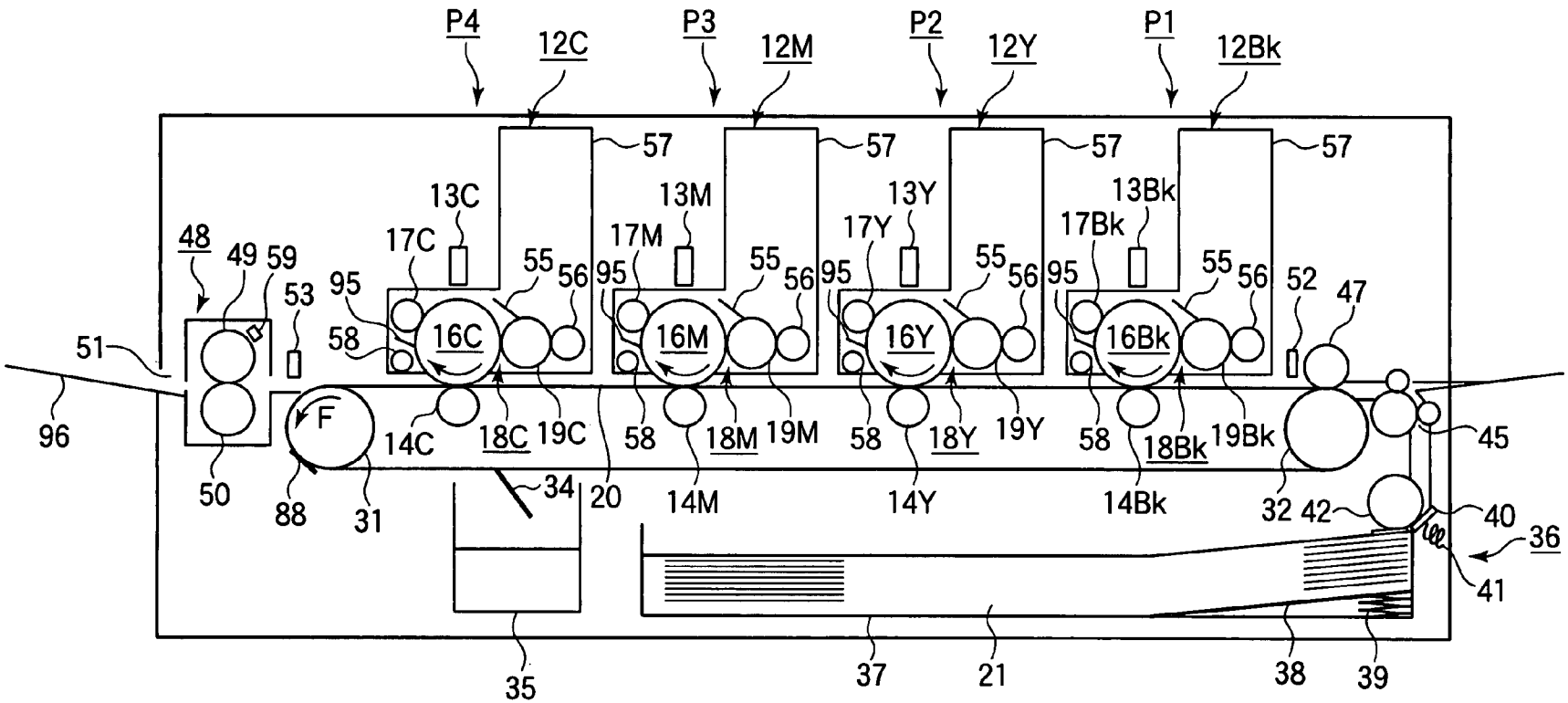
FIG. 1 illustrates a general configuration of a printer according to a first embodiment.

FIG. 1 illustrates a general configuration of a printer according to a first embodiment.

Referring to FIG. 1, a tandem type printer includes first to fourth print engines P1–P4 aligned in a direction in which a recording medium 21 such as paper and OHP is transported for printing. The print engines P1–P4 are an electrophotographic LED printing mechanism.

The first print engine P1 prints black images and includes an image forming section 12BK, an LED head 13BK, and a transfer roller 14BK. The LED head 13BK illuminates the charged surface of a photoconductive drum 16BK in accordance with print data. The transfer roller 14BK transfers a toner image formed on the photoconductive drum 16BK onto the recording medium 21.

The second print engine P2 prints yellow images and includes an image forming section 12Y, an LED head 13Y, and a transfer roller 14Y. The LED head 13Y illuminates the charged surface of a photoconductive drum 16Y in accordance with print data. The transfer roller 14Y transfers a toner image formed on the photoconductive drum 16Y onto the recording medium 21.

The third print engine P3 prints magenta images and includes an image forming section 12M, an LED head 13M, and a transfer roller 14M. The LED head 13M illuminates the charged surface of a photoconductive drum 16M in accordance with print data. The transfer roller 14M transfers a toner image formed on the photoconductive drum 16M onto the recording medium 21.

The fourth print engine P4 prints cyan images and includes an image forming section 12C, an LED head 13C, and a transfer roller 14C. The LED head 13C illuminates the charged surface of a photoconductive drum 16C in accordance with print data. The transfer roller 14C transfers a toner image formed on the photoconductive drum 16C onto the recording medium 21.

The image forming sections 12BK, 12Y, 12M, and 12C include photoconductive drums 16BK, 16Y, 16M, and 16C, changing roller 17BK, 17Y, 17M, and 17C, and developing units 18BK, 18Y, 18M, and 18C.

The developing units 18BK, 18Y, 18M, and 18C include developing rollers 19BK, 19Y, 19M, and 19C, each of which is formed of a semiconductive rubber material and is in pressure contact with a developing blade 55 and a sponge roller 56. Each image forming section has a toner cartridge 57 that holds one-component toner of a corresponding color. The toner cartridge 57 may be formed integrally with the image forming section or detachably mounted to the image forming section.

Cleaning blades 95 are in pressure contact with the photoconductive drums 16BK, 16Y, 16M, and 16C and scrape residual toner from the surfaces of the photoconductive drums 16BK, 16Y, 16M, and 16C. The residual toner scraped off the photoconductive drums 16BK, 16Y, 16M, and 16C is transported by a spiral screw 58 into a waste toner reservoir, not shown.

The function of the developing units 18BK, 18Y, 18M, and 18C will be described.

The toners supplied from the toner cartridges 57 are transferred to the developing rollers 19BK, 19Y, 19M, and 19C via the sponge rollers 56. The developing blades 55 form a thin layer of toner on the surfaces of the developing rollers 19BK, 19Y, 19M, and 19C. As the developing roller rotates, the thin toner layer is brought into contact with the photoconductive drum. When the developing blade forms a toner layer on the photoconductive drum, the toner is subjected to strong friction so that the toner is charged. In this embodiment, the toner is charged negatively.

The LED head will be described.

The LED head includes LED arrays, drive ICs that drive the LED arrays, a printed circuit board on which the LED arrays and the drive ICs are mounted, and a rod lens array that focuses the light emitted from the LED arrays on the surfaces of the photoconductive drum. The drive ICs drive the light emitting diodes of the LED arrays to selectively illuminate the surface of the photoconductive drum in accordance with print data to form an electrostatic latent image. The toner is attracted to the electrostatic latent image by the Coulomb force to form a toner image.

A transport belt 20 is an endless belt and sandwiched between the photoconductive drums 16BK, 16Y, 16M, and 16C and the transfer rollers 14BK, 14Y, 14M, and 14C. The transfer belt 20 runs in contact with the photoconductive drums 16BK, 16Y, 16M, and 16C through the image forming sections 12BK, 12Y, 12M, and 12C.

The transport belt 20 is made of a semiconductive plastic film having a high resistance and extends around a drive roller 31, a driven roller 32 and a tension roller, not shown. The resistance of the transport belt 20 is selected to be in the range such that the recording medium 21 is sufficiently attracted to the transport belt 20 but neutralized by itself after the recording medium 21 leaves the transport belt 20.

A motor 74 drives the drive roller 31 to rotate in a direction shown by arrow F, thereby causing the transport belt 20 to run.

The upper half portion of the transport belt 20 runs through transfer points in the print engines P1–P4 and the lower half portion runs in contact with the cleaning blade 34. The cleaning blade 34 is made of a resilient rubber material or a resilient plastic material and scrapes residual toner off the transfer belt 20 into a waste toner reservoir 35.

A medium feeding mechanism 36 is disposed at a lower right portion of the printer. The medium feeding mechanism 36 includes a medium tray 37, a hopping mechanism, and a registry roller 45. The medium tray 37 has a push-up plate 38 and an urging member 39. The hopping mechanism includes a separator 40, a feeding roller 42, and a spring 41 that urges the separator 40 against the feeding roller 42.

The urging member 39 urges the push-up plate 38 in such a way that the top surface of a stack of the recording medium 21 held in the medium tray 37 is in pressure contact with the feeding roller 42. When the feeding roller 42 rotates, the separator 40 in pressure contact with the feeding roller 42 facilitates the feeding of the recording medium to the registry roller 45 on a sheet-by-sheet basis.

The recording medium 21 is fed between an attraction roller 47 and the transport belt 20. The transport belt 20 is sandwiched between the attraction roller 47 and the driven roller 32 in such a way that the attraction roller 47 is in pressure contact with the transport belt 20. The attraction roller 47 causes the recording medium 21 to be charged, so that the recording medium 21 is attracted to the transport belt 20 by the Coulomb force. The attraction roller 47 is made of a high resistance semiconductive rubber material. A photo sensor 52 is disposed between the attraction roller 47 and the image forming section 12BK and detects the leading end of the recording medium 21. A photo sensor 53 is disposed downstream of the image forming section 12C with respect to the direction of travel of the recording medium 21, and detects the trailing end of the recording medium 21.

A fixing unit 48 is located downstream of the photo sensor 53 and fixes the toner images that have been transferred onto the recording medium during the passage of the recording medium 21 through the image forming sections. The fixing unit 48 includes a heat roller 49 that heats the toner images on the recording medium 21 and a pressure roller 50 that urges the recording medium 21 against the heat roller 49.

The heat roller 49 is a metal core such as aluminum covered with an elastomer, for example, silicone rubber. The elastomer is covered with fluoroplastics for preventing offset from being formed on the resilient material. The pressure roller 50 is a metal core such as aluminum covered with an elastomer such as silicone. A thermistor 59 is disposed to oppose the heat roller 49 and detects the temperature of the heat roller 49. The heat roller 49 includes a heater, not shown. The controller 61 controllably electrically energizes the heater so that the heater is turned on and off in accordance with the temperature detected by the thermistor 59, so that the heat roller 49 is maintained at a predetermined fixing temperature.

An exit 51 is located downstream of the fixing unit 48 and a stacker 96 is disposed at the outside of the exit 51. The recording medium 21 having a full color permanent image thereon is discharged through the exit 51 onto the stacker 96.

Figure 2A:
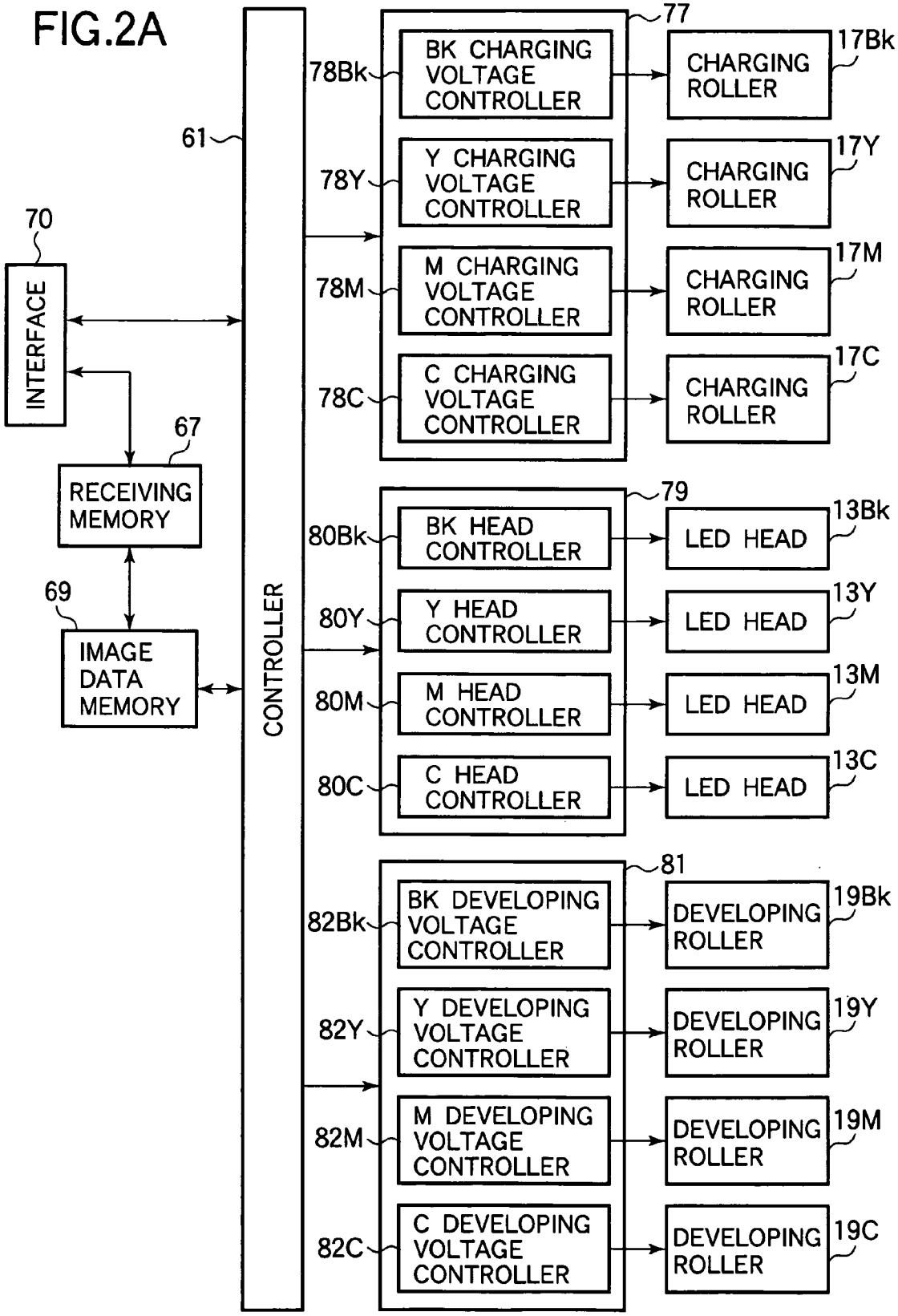
FIGS. 2A and 2B are control block diagrams illustrating an overall configuration of a printer according to the first embodiment.
Figure 2B:
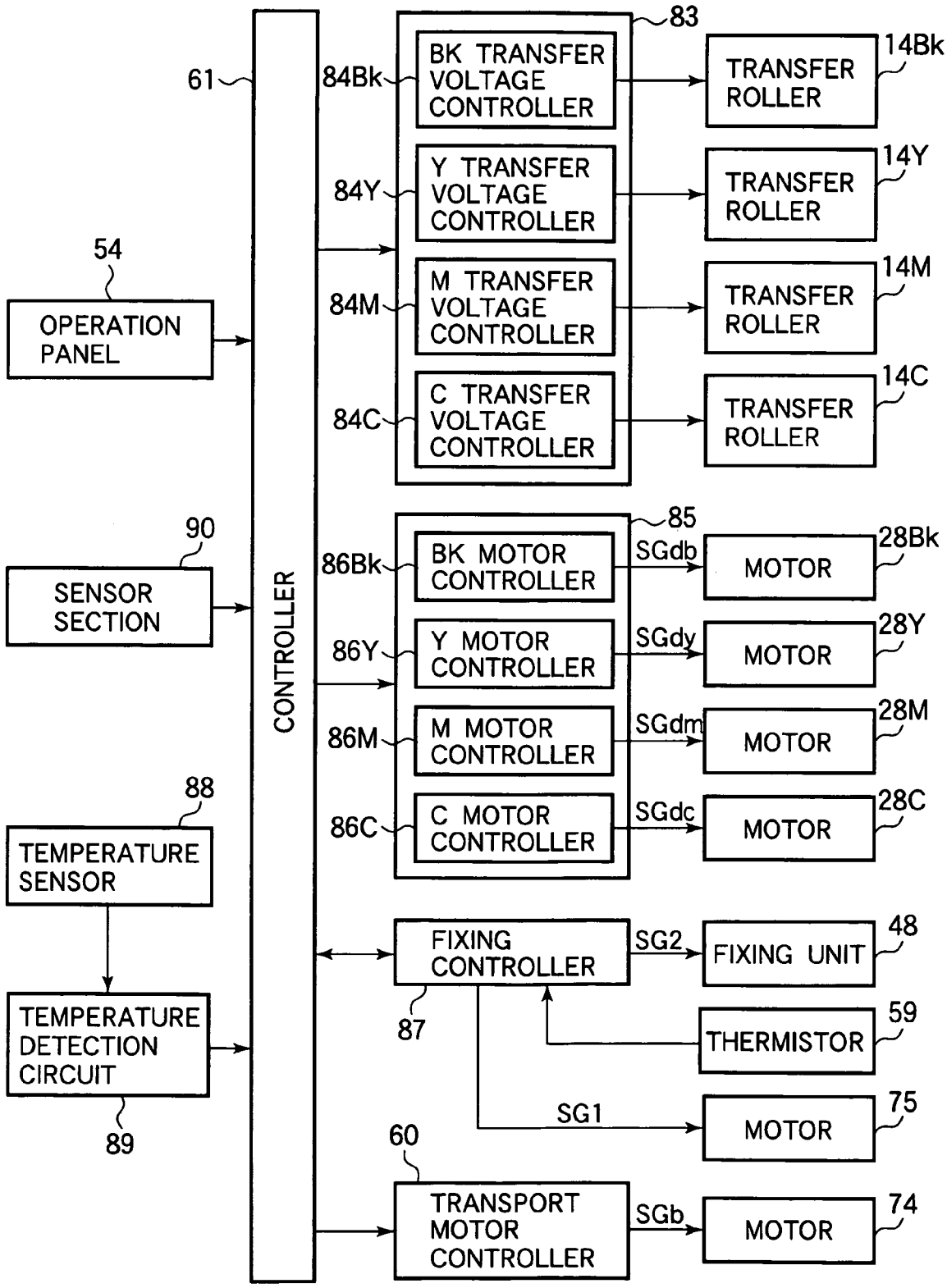

FIGS. 2A and 2B are block diagrams illustrating a controller of the printer.

Referring to FIGS. 2A and 2B, the controller 61 primarily includes a microprocessor, a ROM, a RAM, an I/O port. and a timer. The controller 61 receives print data and control commands from a host computer through an interface 70, and performs the overall control of the printer for color image formation. The interface 70 transmits information on the current status of the printer to the host computer, analyzes the control commands received from the host computer, and stores the received print data into a receiving memory 67 for each color. The print data input through the interface 70 is edited in the controller 61 and the edited data is stored as image data for the respective colors into an image data memory 69.

An operation panel 54 has switches, not shown, through which the user inputs commands into the printer, and LEDs, not shown, that indicate the current status of the printer.

A sensor section 90 includes sensors, not shown, for detecting temperature and humidity at various areas in the printer, and sensors, not shown, for detecting the density of color images. The outputs of the sensor section 90 are sent to the controller 61.

The controller 61 is connected to a charging controller 77, a head controller 79, a developing controller 81, a transfer controller 83, a motor controller 85, a fixing controller 87, and a transport motor controller 60.

In response to a command from the controller 61, the charging controller 77 applies voltages to the respective charging rollers 17BK, 17Y, 17M, and 17C to control the charging of the surfaces of the photoconductive drums 16BK, 16Y, 16M, and 16C. The charging controller 77 includes charging voltage controllers 78BK, 78Y, 78M, and 78C that perform the control for the respective colors.

Upon receiving a command from the controller 61, the head controller 79 receives image data for the respective colors from the image data memory 69 and sends the image data to the LED heads 13BK, 13Y, 13M, and 13C. The LEDs of a corresponding LED head is selectively energized in accordance with the image data to form an electrostatic latent image of a corresponding color on the photoconductive drum. The head controller 79 controls head controllers 80BK, 80Y, 80M, and 80C.

Upon receiving a command from the controller 61, the developing controller 81 applies voltages to the developing rollers 16BK, 16Y, 16M, and 16C so that toners of the corresponding colors are deposited to the photoconductive drums 16BK, 16Y, 16M, and 16C to form toner images of the corresponding colors. The developing controller 81 controls developing voltage controllers 82BK, 82Y, 82M, and 82C.

Upon receiving a command from the controller 61, the transfer controller 83 applies voltages to the transfer rollers 14BK, 14Y, 14M, and 14C to transfer toner image from the photoconductive drums 16BK, 16Y, 16M, and 16C onto the recording medium 21. The transfer controller 83 includes transfer voltage controllers 84BK, 84Y, 84M, and 84C that transfer toner images of the respective colors onto the recording medium 21.

Upon receiving a command from the controller 61, the motor controller 85 drives motors 28BK, 28Y, 28M, and 28C to rotate the photoconductive drums 16BK, 16Y, 16M, and 16C and developing rollers 19BK, 19Y, 19M, and 19C. The motor controller 85 includes motor controllers 86BK, 86Y, 86M, and 86C.

Upon receiving a command from the controller 61, the fixing controller 87 applies a voltage to a heater built in the fixing unit 48. The fixing controller 87 turns on and off the heater in accordance with the temperature detected by the thermistor 59. When the fixing unit 48 reaches a predetermined temperature, the fixing unit 87 drives the motor 75 to rotate the heat roller 49 and the pressure roller 50.

The transport motor controller 60 drives the motor 74 to cause the transport belt 20 to run.

The operation of the aforementioned configuration will be described.

Upon receiving a control command and print data from the host computer through the interface 70, the controller 61 sends a command to the fixing controller 87, so that the fixing controller 87 reads the temperature detected by the thermistor 59. Then, the controller 61 determines whether the temperature of the fixing unit 48 is within a normal range in which the fixing unit 48 can fix the toner images on the recording medium 21 properly. If the temperature of the fixing unit 48 is below the lower limit of the normal range, the fixing controller 87 turns on the heater to heat the fixing unit 48 until the temperature of the fixing unit 48 is within the normal range. As soon as the temperature falls in the normal range, the fixing controller 87 drives the motor 75 to rotate the heat roller 49 and the pressure roller 50.

The controller 61 sends a command to the motor controller 85, which in turn drives the motors 28BK, 28Y, 28M, and 28C to rotate the photoconductive drums 16BK, 16Y, 16M, and 16C and the developing rollers 19BK, 19Y, 19M, and 19C. The controller 61 sends a command to the charging controller 77, developing controller 81, and transfer controller 83, which in turn apply voltages to the charging rollers 17BK, 17Y, 17M, and 17C, developing rollers 19BK, 19Y, 19M, and 19C, and transfer rollers 14BK, 14Y, 14M, and 14C.

By means of a medium supply level sensor and a medium size sensor, the controller 61 reads the supply level and size of the recording medium 21 remaining in the medium tray 37. In order to transport the recording medium 21 according to its type, the controller 61 sends a command to the transport motor controller 60, which in turn drives the motor 74 to rotate the drive roller 31, thereby initiating the transport of the recording medium 21. The motor 74 can rotate in the forward and reverse directions. When the motor 74 rotates in the reverse direction, the feeding roller 42 rotates to feed the recording medium 21 from the medium tray 37. Then the feeding roller 42 causes the recording medium 21 to advance by a predetermined distance until the leading end of the recording medium 21 is detected by a medium entrance sensor, not shown. Subsequently, when the motor 74 rotates in the forward direction, the registry roller 45 rotates to advance the recording medium 21 to the transfer section of the first print engine P1.

When the recording medium 21 arrives at a predetermined position in the first print engine P1, the controller 61 reads image data from the image data memory 69 and sends it to the head controller 79. The head controller 79 receives image data for one line and sends the image data and a latch signal to the LED heads 13BK, 13Y, 13M, and 13C, so that the LED heads 13BK, 13Y, 13M, and 13C hold the image data of corresponding colors. The head controller 79 sends a print drive signal STB to the LED heads 13BK, 13Y, 13M, and 13C, so that the LED heads 13BK, 13Y, 13M, and 13C selectively energize LEDs of the corresponding LED arrays in accordance with the image data for one line.

The LED heads 13BK, 13Y, 13M, and 13C illuminate the corresponding photoconductive drums 16BK, 16Y, 16M, and 16C to form dots on the surfaces of the photoconductive drums 16BK, 16Y, 16M, and 16C. The dots have a higher potential than non-illuminated areas and forming an electrostatic latent image as a whole. Negatively charged toner particles are attracted to the dots by the Coulomb force to form a toner image as a whole. Then, the toner image on the photoconductive drum reaches a corresponding transfer point. The controller 61 sends a command to cause the transfer controller 83 to apply positive transfer voltages to the transfer rollers 14BK, 14Y, 14M, and 14C. As a result, the transfer rollers 14BK, 14Y, 14M, and 14C transfer the toner images of the corresponding colors onto the recording medium 21, thereby forming a full color toner image on the recording medium 21.

The recording medium 21 having a full color toner image thereon is then advanced to the fixing unit 48 where the full color toner image is heated and pressed on the recording medium 21 into a full color permanent image. The recording medium 21 is further advanced to pass by an exit sensor and discharged out of the printer.

When the recording medium 21 passes the exit sensor, the controller 61 stops applying voltages to the developing rollers 19BK, 19Y, 19M, and 19C, transfer rollers 14BK, 14Y, 14M, and 14C, and then stops driving motors 28BK, 28Y, 28M, 28C and motor 74 and 75.

The printer incorporates many driving mechanisms. These driving mechanisms generate heat. In particular, the heat roller 49 is maintained at a temperature higher than 150° C. for fusing the toner images and is a source of a large amount of heat. The motors 28BK, 28Y, 28M, 28C, 74, and 75 also radiate heat when they are driven.

Changes in environmental condition and continuous printing of a large number of pages cause changes in printing condition, which in turn cause changes in the interior temperature of the printer. Especially, the temperature in an area between the fixing unit 48 and the fourth print engine P4 will exceed 50° C.

Generally, when ambient temperature increases extremely, the fluidity of toner in the image forming section decreases so that toner cannot be transported smoothly by a developing roller in a developing unit. The toner continues to be agitated to agglomerate within the developing unit. This causes degradation of the density, gamma characteristic, and smoothness of continuously changing gradation of halftone images that should be expressed by critical shades of color.

Toner acquires more charges in a high temperature and high humidity environment. Toner having a large amount of charge adheres to the background area of the recording medium 21, causing soiling of the printed image. As the temperature of toner increases, the toner softens gradually, tending to agglomerate. The deposition of softened toner on the photoconductive drums 16BK, 16Y, 16M, and 16C causes the surface potentials of the photoconductive drums 16BK, 16Y, 16M, and 16C to decrease, leading to soiling of the photoconductive drums 16BK, 16Y, 16M, and 16C.

Therefore, it is desirable that the surface temperatures of the photoconductive drums 16BK, 16Y, 16M, and 16C are monitored and controlled not to exceed a predetermined value. It is difficult, for example, to dispose a thermistor in contact with the surface of a photoconductive drum for detection of the surface temperature of the photoconductive drum. Besides, the surface of a photoconductive drum is coated with a thin film of a special photoconductive material which is sensitive to mechanical damage. Pressing a thermistor against the photoconductive layer in an attempt to detect the surface temperature of the photoconductive layer will scratch the layer easily, presenting a problem of poor image formation.

In the present embodiment, because the transport belt 20 runs in contact with the photoconductive drums 16BK, 16Y, 16M, and 16C, the surface of the transport belt 20 is heated to substantially the same temperature as the photoconductive drums 16BK, 16Y, 16M, and 16C. Thus, the surface temperature of the transport belt 20 is detected, thereby estimating the actual surface temperature of the photoconductive drums 16BK, 16Y, 16M, and 16C.

For this purpose, a temperature sensor 88 is located close to the photoconductive drum 16C and downstream of the photoconductive drum 16C with respect to the direction in which the transport belt 20 runs, so that the temperature sensor 88 does not receive the heat directly from the heat roller 49. The temperature sensor 88 is in pressure contact with the transport belt 20 and is urged toward the drive roller 31, detecting the surface temperature of the transport belt 20 shortly after the receiving medium 21 has left the transport belt 20. The surface temperature of the transport belt 20 is substantially the same as that of the photoconductive drum 16C. The drive roller 31 and photoconductive drums 16BK, 16Y, 16M, and 16C all have a rotational shaft made of aluminum, not shown, and substantially the same heat transferring characteristic, so that the drive roller 31 is substantially at the same temperature as the surfaces of the photoconductive drums 16BK, 16Y, 16M, and 16C.

Because the temperature sensor 88 faces a curved portion of the drive roller 31, the temperature sensor 88 can be in pressure contact with the transport belt 20 without difficulty.

The output of the temperature sensor 88 is converted into a detection voltage by a temperature detection circuit 89, the detection voltage being provided to the controller 61. The controller 61 performs a temperature detection operation in which the detection voltage is read and interpreted into the temperature of the transport belt 20. In this manner, the surface temperatures of the photoconductive drums 16BK, 16Y, 16M, and 16C can be estimated by detecting the surface temperature of the transport belt 20.

The temperature sensor 88 may be disposed close to the photoconductive drum 16C to more accurately estimate the temperature of the photoconductive drum 16C. Further, the temperature sensor 88 may also be disposed near the end of the LED head 13C to detect the temperature of the end portion of the LED head 13C to more accurately estimate the surface temperature of the photoconductive drum 16C.

Figures 3, 4:
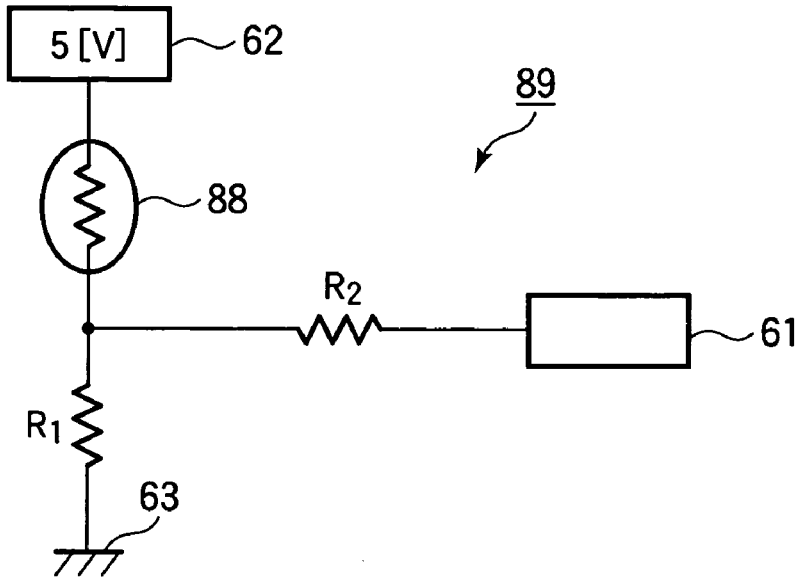
FIG. 3 is a block diagram of a temperature-detecting device according to the first embodiment of the invention.
FIG. 4 is a temperature table.

FIG. 3 is a block diagram of a temperature detecting device according to the first embodiment of the invention, the temperature detecting device detecting the temperature of the transport belt 20. FIG. 4 is a temperature table.

Referring to FIG. 3, a 5 V power supply 62 is connected to the ground 63 via a series circuit of the temperature sensor 88 and a resistor R1. The junction between the temperature sensor 88 and the resistor R1 is connected via a resistor R2 to the controller 61.

The temperature sensor 88 takes the form of a thermistor that has a temperature characteristic in FIG. 4. As is clear from FIG. 4, the resistance of the temperature sensor 88 decreases with increasing temperature, so that the voltage across the resistor R1 becomes higher with increasing temperature.

The operation of the aforementioned printer will be described. The description will be focussed on the operation of the printer after the image data has been edited completely.

Figure 5:
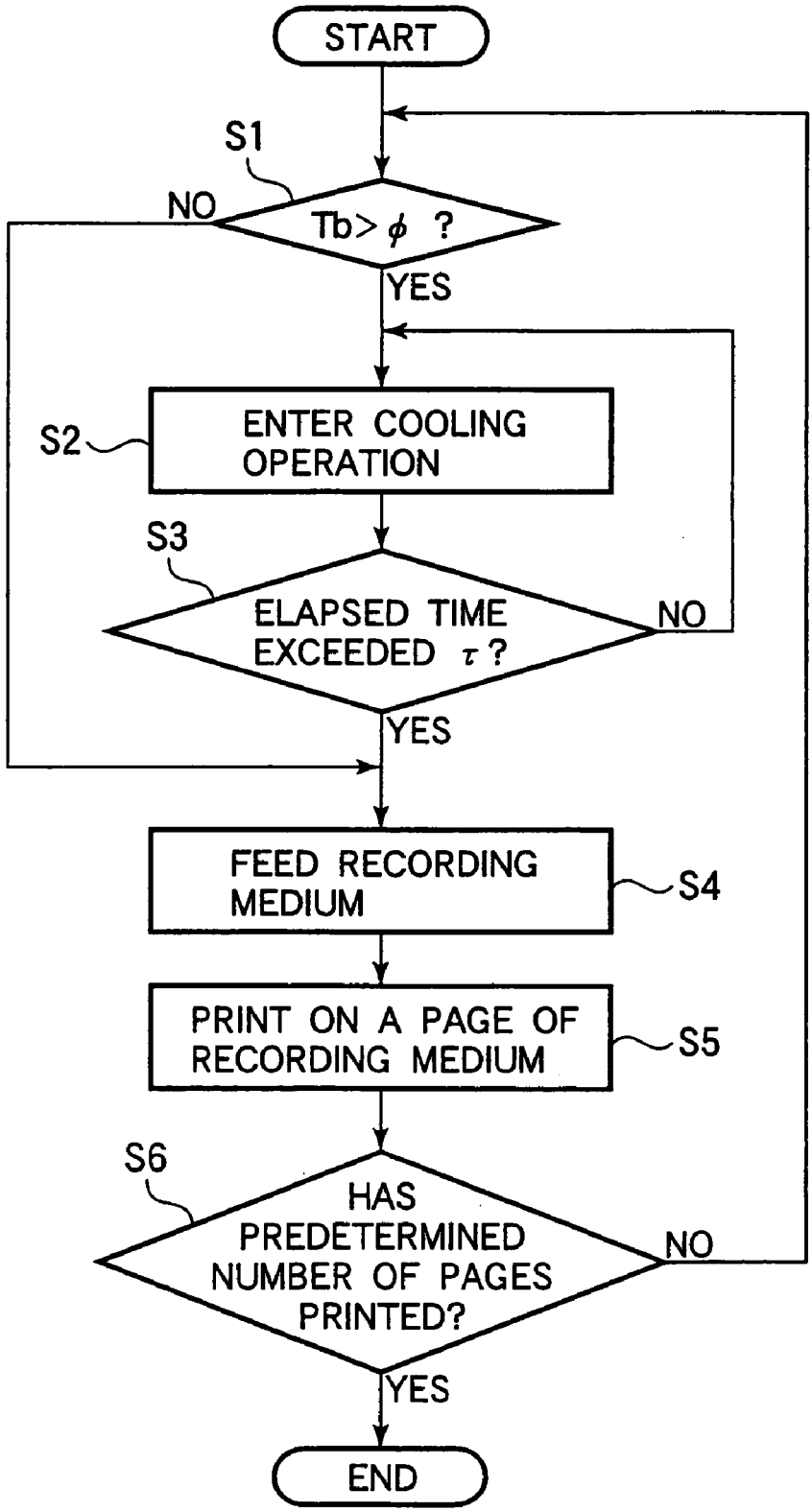
FIG. 5 is a flowchart illustrating the operation of the printer.

FIG. 5 is a flowchart illustrating the operation of the printer.

Figure 6:
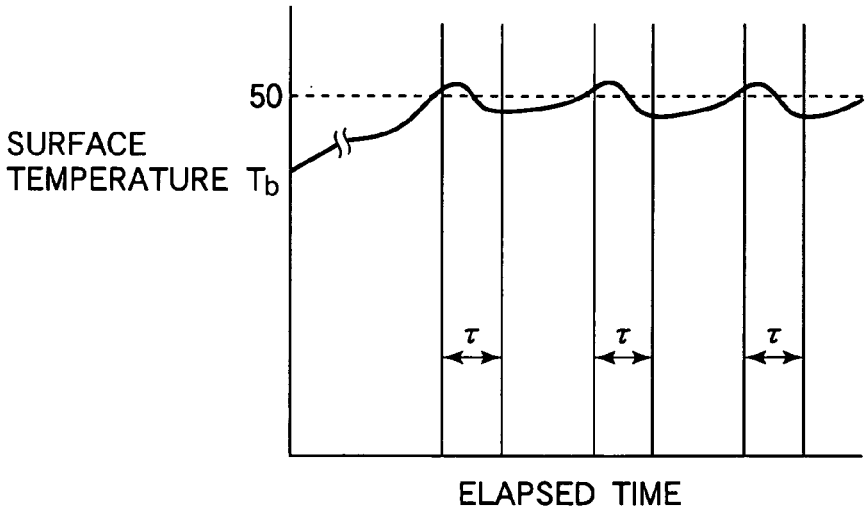
FIG. 6 illustrates the relation between detected temperatures and time elapsed.

FIG. 6 illustrates the relation between the detected temperature and time elapsed.

The controller 61 reads the detection voltage and compares the detection voltage with the values in the temperature table in FIG. 4 stored in a ROM, thereby determining a surface temperature Tb of the transport belt 20. Subsequently, the controller 61 determines (Step S1) whether the surface temperature Tb is higher than a threshold $\phi$ (50° C. in the first embodiment). If $Tb>\phi$, the controller 61 performs a cooling operation in which the medium feeding mechanism does not feed the recording medium 21 (Step S2) and printing is not initiated until a predetermined time $\tau$ (20 seconds in the first embodiment) has elapsed. In this manner, the printer may enter a standby state to halt printing. A check is made to determine whether an elapsed time exceeds a setting $\tau$ (Step S3). If the elapsed time exceeds the setting $\tau$, the controller 61 feeds the recording medium 21 (Step S4). Then, printing is performed on a page of the recording medium 21 (Step S5). A check is made to determine whether a predetermined number of pages have been printed (Step S6). It is to be noted that a check is made to determine whether the surface temperature Tb is higher than a threshold $\phi$, before each page of recording medium is printed on.

When the controller 61 determines whether the surface temperature Tb is higher than the threshold $\phi$, the detected voltage is compared with 2.712 V. While the threshold $\phi$ is selected to be 50° C. in the embodiment, the threshold value $\phi$ can be selected from a variety of values depending on the characteristic of toner used. The threshold $\phi$ is determined experimentally by considering a temperature at which the fluidity of toner decreases, the amount of charge of toner increases, and toner softens. Then, the threshold $\phi$ is stored in a ROM or RAM. When a different type of toner is used or the printing speed is changed, another value of the threshold (b may be set from the operation panel 54 in FIG. 2B.

The time $\tau$ is a time length required for the detected temperature Tb to decrease below 50° C. The time $\tau$ depends on the construction of the printer and whether a cooling means (e.g., cooling fan) is provided. The time $\tau$ is such that the inside temperature of the printer is prevented from increasing significantly when printing is performed intermittently at intervals of $\tau$. The time $\tau$ is set to as short a value as possible.

In this manner, when the surface temperature of the transport belt 20 decreases below 50° C., a paper-feeding operation is performed and the controller 61 initiates printing. When continuous printing is performed, the aforementioned steps illustrated in FIG. 5 are repeatedly executed until all pages have been printed.

In the standby state of the printer, the controller 61 does not hold the recording medium 21 in the medium tray 37 but allows the recording medium 21 to advance until the leading edge of the recording medium 21 takes up a position immediately before the photo sensor 52. Meanwhile, the controller 61 decreases the temperature setting of the fixing unit 48 or turns off the fixing unit 48, thereby lowering the temperatures of the photoconductive drums 16BK, 16Y, 16M, and 16C and therefore the interior temperature of the printer.

Figure 7:
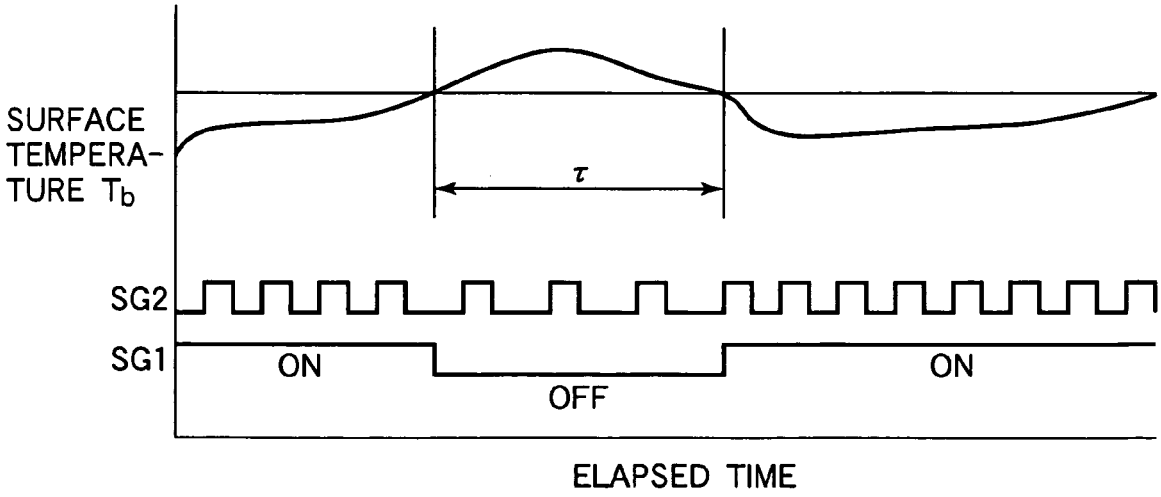
FIG. 7 illustrates the detected temperatures and control signals before printing is initiated.

FIG. 7 illustrates the detected temperatures and the control signals in a low duty mode when the cooling operation is performed.

When the temperature of the fixing unit 48 is to be decreased, the controller 61 sets a fixing motor controlling signal SG1 to "OFF" and changes a heater controlling signal SG2 to a decreased duty cycle. In other words, the heater continues to be controlled ON and OFF with a lower duty cycle so that the surface temperature Tb decreases rather slowly. The heater is controlled to maintain the temperature of the fixing unit 48 close to the predetermined temperature. Therefore, when printing is initiated after the time length $\tau$, the fixing unit 48 can increase to a predetermined temperature quickly. This allows quick start of printing when printing is to be initiated.

Figure 8:
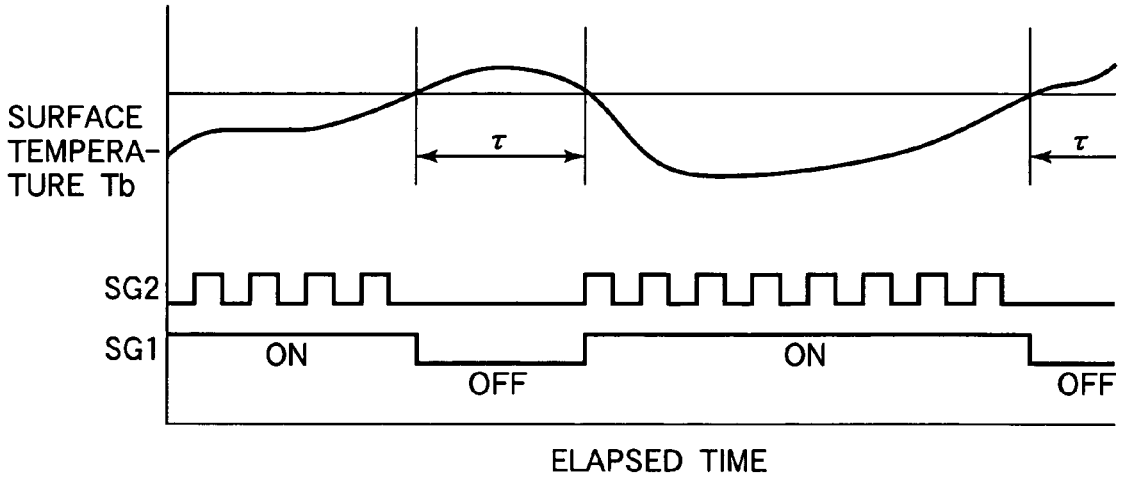
FIG. 8 illustrates the detected temperatures and control signals before printing is initiated.

FIG. 8 illustrates the detected temperatures and the control signals in an off mode when the cooling operation is performed.

When the heater is to be turned off, the controller 61 causes the fixing unit motor controlling signal SG1 and the heater controlling signal SG2 to be "OFF" for the time length $\tau$ as shown in FIG. 8. In other words, the fixing unit motor 75 stops rotating and the heater is de-energized electrically. Because the heater is turned off for the time length $\tau$, the surface temperature Tb becomes low after a predetermined time length so that the interior temperature of the printer quickly decreases. Because the temperature of the heater has been low, when printing is initiated after the time length $\tau$, it requires a long time for the fixing unit 48 to reach a predetermined temperature. Therefore, printing cannot be initiated immediately.

The cooling of the fixing unit 48 can be achieved by either lowering the temperature setting of the fixing unit 48 or switching off the heater, depending on the construction of the printer, the characteristics of the components used in the fixing unit 48, and required image quality.

If Tb>$\phi$, the fixing unit 48 is operated in a low-duty control mode or in an off control mode, thereby preventing the interior temperature of the printer and the surfaces of the photoconductive drums 16BK, 16Y, 16M, and 16C from increasing.

The operation for cooling the fixing unit 48 will prevent the fluidity of the toner in the image forming sections 12BK, 12Y, 12M, and 12C from decreasing, thereby improving the ability of the developing rollers 19BK, 19Y, 19M, and 19C to transfer the toner. Thus, continuous agitation of the toner in the developing units 18BK, 18Y, 18M, 18C will not cause agglomeration of toner, resulting in improved reproducibility of halftone density of the printed images as well as preventing steep gamma characteristics and changes in gradation.

Further, toner is prevented from being overcharged, so that the toner will not adhere to the background areas on the recording medium 21, thereby preventing soiling of the recording medium 21. Non-agglomeration of toner prevents the surface potential of the photoconductive drums 16BK, 16Y,M, 16C from decreasing, thereby preventing soiling of the photoconductive drums 16BK, 16Y, 16M, and 16C.

In the first embodiment, because the temperature of the transport belt 20 is detected, there is no chance of the surfaces of the photoconductive drums 16BK, 16Y, 16M, and 16C being damaged and the detected temperature is substantially the same as that of the photoconductive drums 16BK, 16Y, 16M, and 16C.

The first embodiment eliminates the need for detecting the temperature of the photoconductive drums 16BK, 16Y, 16M, and 16C in a non-contact detection method, reducing the cost of the temperature sensor 88 as well as requiring only a small space for mounting the temperature sensor 88.

The flowchart in FIG. 5 will be described.

Step S1: A check is made to determine whether the detected temperature Tb is higher than $\phi$. If Tb>$\phi$, the program proceeds to step S2. If Tb$\leqq\phi$, the program proceeds to step S4.

Step S2: The controller does not feed the recording medium 21 but enters the cooling operation.

Step S3: A check is made to determine whether an elapsed time exceeds a setting $\tau$. If the elapsed time exceeds the setting $\tau$, the program proceeds to step S4. If the elapsed time has not exceeded the setting $\tau$ the program proceeds to step S2.

Step S4: The controller 61 feeds a page of the recording medium 21.

Step S5: Printing is performed on the page of the recording medium 21.

Step S6: A check is made to determine whether a predetermined number of pages have been printed. If the predetermined number of pages have been printed, the operation completes. If the predetermined number of pages have not been printed, the program jumps back to step S1.

In the embodiment, when the detected temperature Tb is higher than the threshold $\phi$, the fixing unit 48 operates either in the low-duty control mode or in the off control mode. In the off control mode, the motor 75 (FIG. 2B) may be driven with the heater turned off, and the heat roller 49 is rotated in an idling manner.

In the present embodiment, when the surface temperature of the photoconductive drum exceeds the threshold $\phi$, printing is halted for the time length $\tau$, thereby preventing the temperature of the photoconductive drum from increasing. Alternatively, the surface temperature of the photoconductive drum is detected at predetermined intervals so that printing is resumed as soon as the surface temperature becomes lower than the threshold ϕ. In the present embodiment, the surface temperature of the photoconductive drum is detected every time a page of recording medium is printed, thereby preventing the temperature of the photoconductive drum from increasing. Alternatively, the surface temperature of the photoconductive drum may be detected upon receiving a print job, thereby preventing the surface temperature of the photoconductive drum from increasing. This way of detecting the surface temperature of the photoconductive drum is still effective.

Rotation of the heat roller 49 in the idling manner will cause the heat roller 49 to radiate heat into the air of a lower temperature than the heat roller 49, so that the heat roller 49 can be cooled faster. This decreases the detection temperature Tb in a short time, resulting in a shorter setting τ and an increased throughput of the printer.

During the idle rotation of the heat roller 49, the transport belt 20 and photoconductive drums 16BK, 16Y, 16M, and 16C may be controlled to run in the idling manner.

Figure 9:
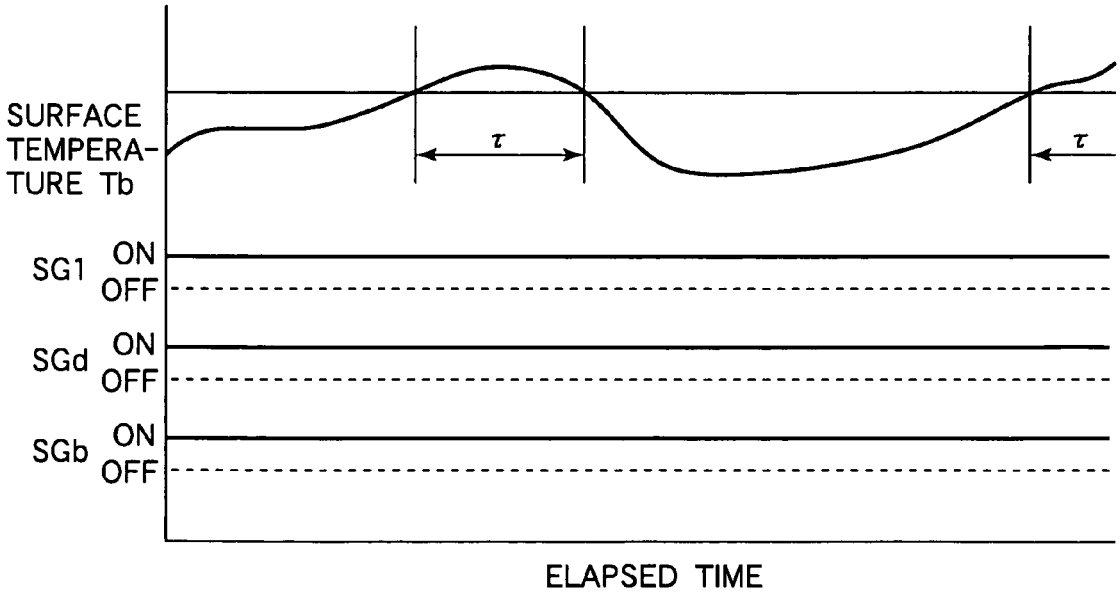
FIG. 9 illustrates the detected temperatures and control signals in the idling manner.

FIG. 9 illustrates the detected temperatures and the control signals before printing is initiated when the heat roller photoconductive drums 16BK, 16Y, 16M, and 16C and transport belt 20 run in the idling manner.

The controller 61 turns off the heater controlling signal SG2 during the setting τ and turns on the fixing motor controlling signal SG1 that drives the motor 75 (FIG. 2B) in rotation, thereby rotating the heat roller 49 (FIG. 1) in the idling manner. The controller also turns on a drum motor controlling signal SGd that drives the respective motors 28BK, 28Y, 28M, 28C in rotation, thereby driving the photoconductive drums 16BK, 16Y, 16M, and 16C and the transfer rollers, charging rollers, and developing rollers to rotate in the idling manner. Further, the controller 61 turns on the transport belt motor controlling signal SGb that drives the motor 74 in rotation, thereby driving the transport belt 20 to run in the idling manner.

As a result, the heat stored in the photoconductive drums 16BK, 16Y, 16M, and 16C and the transport belt 20 is radiated into the air of a temperature lower than the photoconductive drums 16BK, 16Y, 16M, and 16C and transport belt 20.

The image forming sections 12BK, 12Y, 12M, and 12C are aligned in a direction in which the transport belt 20 runs, so that a photoconductive drum closest to the fixing unit 48 receives a larger amount of heat than the rest of the photoconductive drums. Causing the transport belt 20 to run in an idling manner allows heat stored in the photoconductive drum 16C having a higher surface temperature to be transferred to the photoconductive drums 16BK, 16Y, 16M having a lower surface temperature.

Thus, the photoconductive drums 16BK, 16Y, 16M, and 16C and transport belt 20 can be cooled faster, allowing the detected temperature Tb to decrease in a short time. This makes the setting τ shorter and increases the throughout of the printer.

During the idle rotation of the heat roller 49 and the photoconductive drums 16BK, 16Y, 16M, and 16C and the idle running of the transport belt 20, the controller causes the charging controller 77 (FIG. 2A) to apply voltages to the charging rollers 17BK, 17Y, 17M, and 17C to charge the surfaces of the photoconductive drums 16BK, 16Y, 16M, and 16C, respectively. Then, the controller 61 controls the head controller 79 to cause the LED heads 13BK, 13Y, 13M, 13C to stop writing electrostatic latent images, and controls the developing controller 81 to apply voltages of zero volts or voltages having a polarity opposite to that in the normal printing to the developing rollers 19BK, 19Y, 19M, and 19C. Then, the controller 61 controls the transfer controller 83 to stop applying voltages to the transfer rollers 14BK, 14Y, 14M, and 14C. Thus, images are not formed during the idle operation.

The motors 75, 28BK, 28Y, 28M, 28C can be rotated at a higher speed in the idle rotation of the photoconductive drums 16BK, 16Y, 16M, and 16C and the heat roller 49 than in the normal printing operation of the printer. Also, the motor 74 can be rotated faster in the idle rotation of the photoconductive drums than in the normal printing operation of the pritner.

Figure 10:
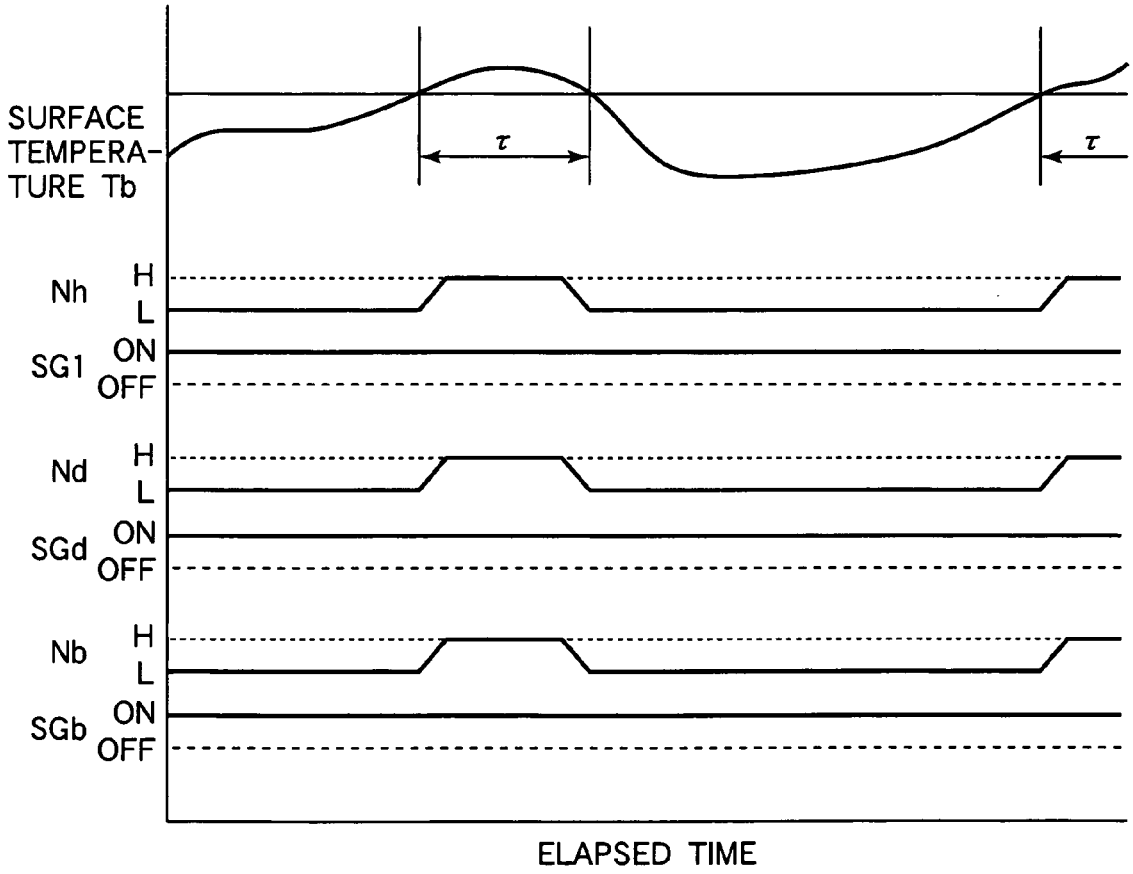
FIG. 10 illustrates the detected temperatures, control signals, and speeds of motors during the idling manner.

FIG. 10 illustrates the detected temperatures and the control signals and speeds of motors during the idling manner.

During the setting τ, the controller 61 turns off the heater controlling signal SG2 and turns on the fixing motor controlling signal SG1 that drives the motor 75 in rotation. The speed Nh of the motor 75 is faster during the length of the setting τ than in the normal printing operation. The controller 61 controls the heat roller 49 to rotate in the idling manner. The drum motor control signal SGd is turned on, so that the speed Nb of motor 28BK, 28Y, 28M, and 28C rotate at a speed higher during the setting τ than in the normal printing operation. The photoconductive drums 16BK, 16Y, 16M, and 16C rotate in the idling manner and transfer rollers 14BK, 14Y, 14M, and 14C, charging rollers 17BK, 17Y, 17M, and 17C, and developing rollers 19BK, 19Y, 19M, and 19C also rotate. The controller 61 turns on the transport belt 20 controlling signal SGb that drives the motor 74 to rotate faster than in the normal printing, so that the transport belt 20 runs faster in the idling manner than in the normal printing operation.

Thus, a larger amount of heat stored in the heat roller 49, photoconductive drums 16BK, 16Y, 16M, and 16C, and transport belt 20 can be radiated into the air.

In the present embodiment, printing is performed at 20 ppm (i.e., 121 mm/s) for black-and-white printing and at 12 ppm (72.6 mm/s) for color printing. If the control program can be simplified, then the speeds of heat roller 49, the photoconductive drums 16BK, 16Y, 16M, and 16C, and transport belt 20 run preferably at 20 ppm. For this purpose, a table of printing speeds may be provided in a storage medium, not shown, so that the table is referred to control the speeds of the heat roller 49, photoconductive drums 16BK, 16Y, 16M, and 16C, and transport belt 20.

Second Embodiment

Figure 11:
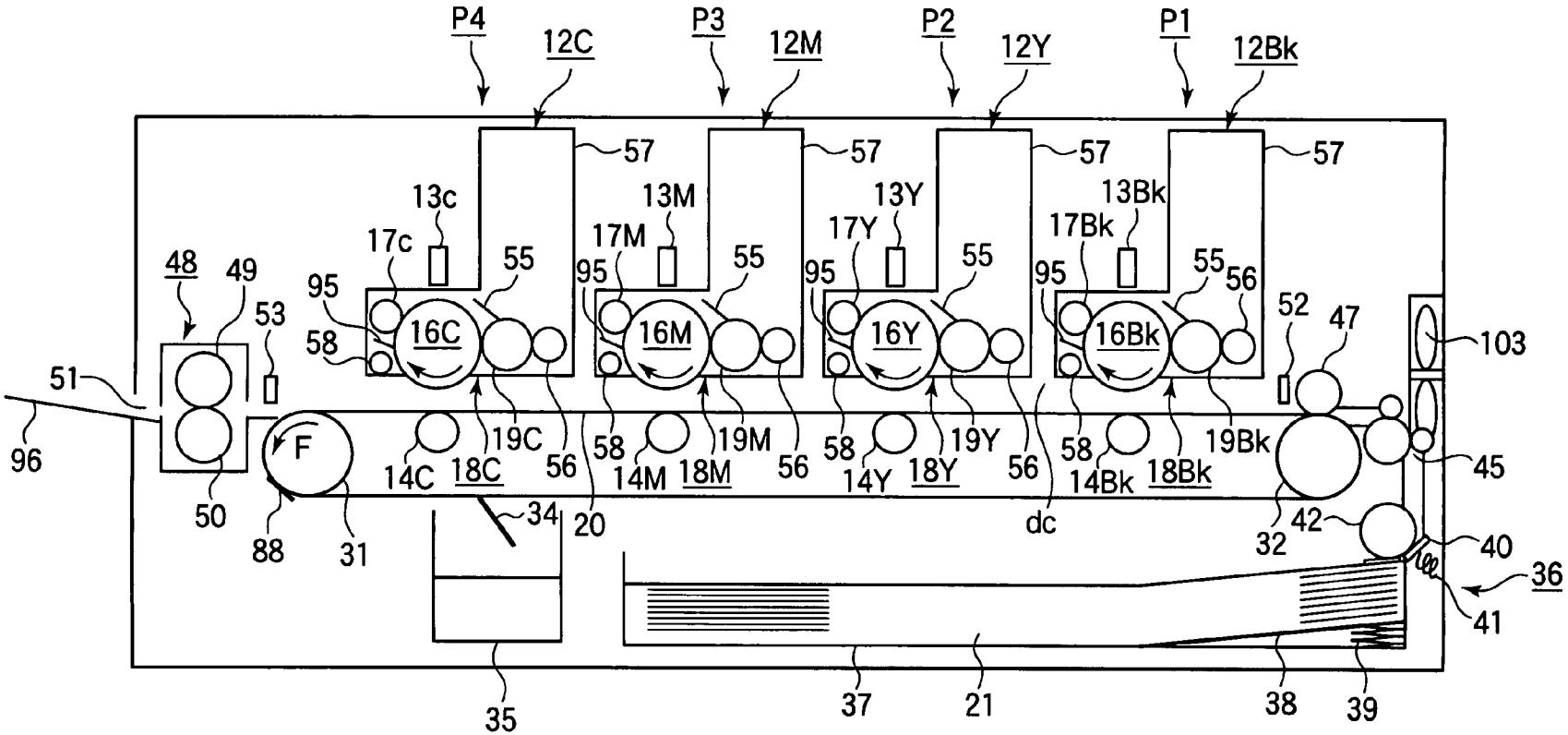
FIG. 11 is a side view in schematic form illustrating a printer according to a second embodiment.
Figure 12:
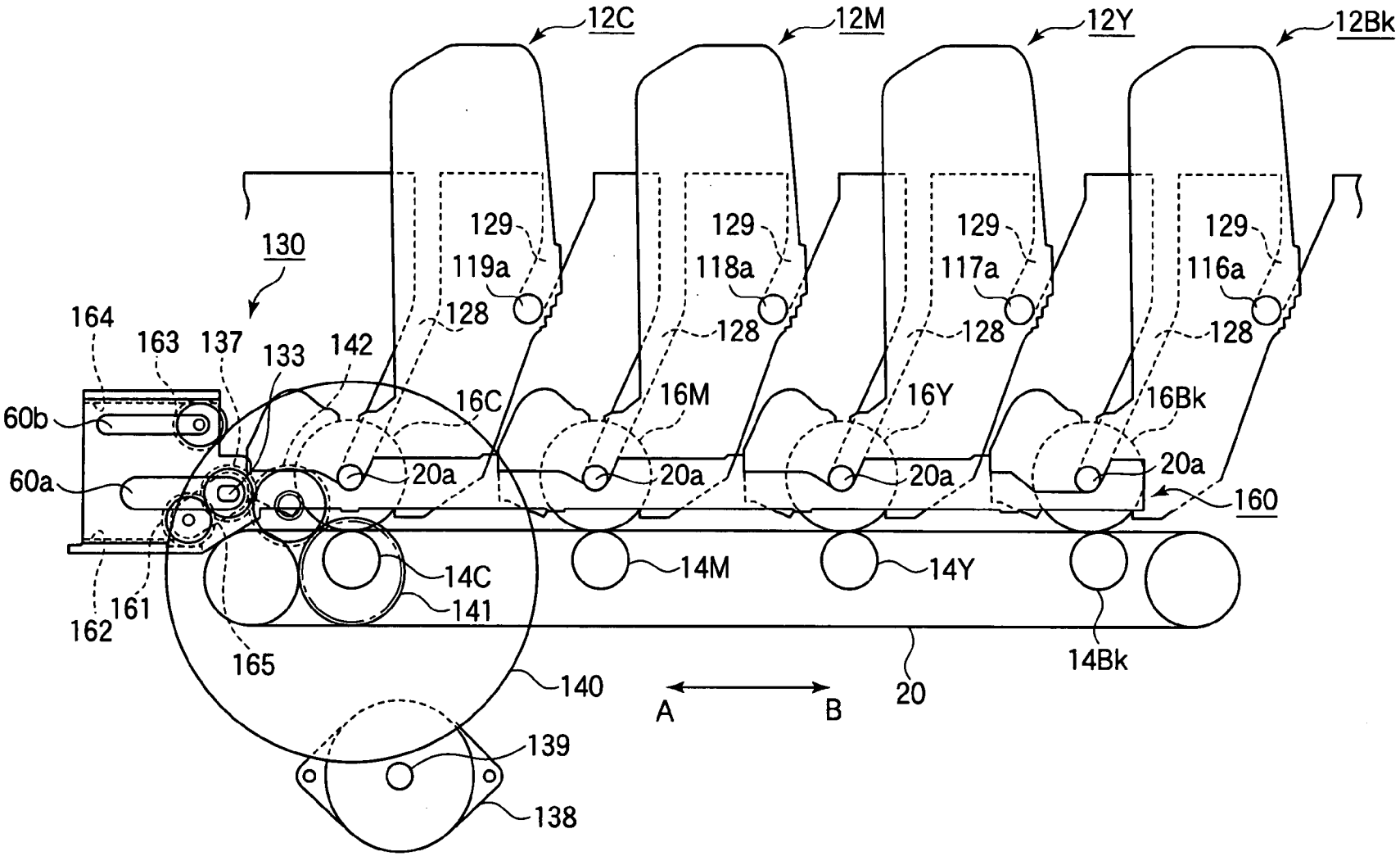
FIG. 12 illustrates the operation of an up-down mechanism.

A second embodiment differs from the first embodiment in that the image forming sections 12BK, 12Y, 12M, and 12C are movable upward to the non-operation position (FIG. 11) and downward to the operative position (FIG. 12). Elements similar to those in the first embodiment have been given the same references and the description is omitted.

FIG. 11 is a side view in schematic form illustrating a printer according to the second embodiment when the image forming sections are at the non-operative position.

The image forming sections 12BK, 12Y, 12M, and 12C are movable downward to the operative position and upward to the non-operative position. The controller 61 performs a cooling operation in which a check is made to determine whether the detected temperature Tb is higher than the threshold ϕ (e.g., 50° C. in the second embodiment) If Tb>ϕ, an up-down mechanism controller 101 (FIG. 15B) controls a drive motor 138 (FIG. 15B) to drive the up-down mechanism 101 in FIGS. 12–14, thereby placing the image forming sections 12BK, 12Y, 12M, and 12C at the non-operative position.

Thus, the photoconductive drums 16BK, 16Y, 16M, and 16C move away from the transport belt 20, creating a gap G of several millimeters between the photoconductive drums and the transport belt 20.

The gap G functions as a duct through which air heated by the heat radiated from photoconductive drums 16BK, 16Y, 16M, and 16C flows to cool the photoconductive drums 16BK, 16Y, 16M, and 16C. The heat radiated from the photoconductive drums 16BK, 16Y, 16M, and 16C can be transferred more efficiently when the gap G is formed than when the gap G is not formed.

When the image forming sections 12BK, 12Y, 12M, and 12C are at the non-operative position, the controller 61 causes a transport motor controller 60 to drive the motor 74 in rotation, thereby causing the transport belt 20 to rum. In this manner, the heat stored in the photoconductive drums 16BK, 16Y, 16M, and 16C and the surroundings can be radiated, thereby cooling the photoconductive drums efficiently.

As described above, for cooling the photoconductive drums 16BK, 16Y, 16M, and 16C, it is only necessary that the image forming sections 12BK, 12Y, 12M, and 12C are placed at the non-operative position and the motor 74 causes the transport belt 20 to run. Therefore, the photoconductive drums 16BK, 16Y, 16M, and 16C need not be rotated in the idling manner.

Thus, not only unwanted power consumption can be prevented but also noise can be minimized.

In order to ensure that a sufficient amount of air flows to cool the printer, a fan 103 is disposed upstream of the gap G with respect to the direction of travel of the recording medium 21. The fan 103 is mounted on a front unit assembly, not shown.

When the image forming sections 12BK, 12Y, 12M, and 12C are at the non-operative position, if the detected temperature Tb is higher than the threshold $\phi$, an air-flow controller 102 (FIG. 15B) causes the fan 103 (FIG. 15B) to operate, thereby sucking air from outside of the printer and causing the sucked air to flow through the gap G toward the fixing unit 48. Thus, the air-flow through the gap G not only forcibly cools down the photoconductive drums 16BK, 16Y, 16M, and 16C but also directly cools down the heat roller 49.

Forced air-flow shortens the time required for cooling the printer while also increasing throughput of the printer. The fan 103 may be disposed downstream of the gap G with respect to the direction of travel of the recording medium 21.

The up-down mechanism 130 will now be described.

FIG. 12 illustrates the operation of the up-down mechanism.

Figure 13A:
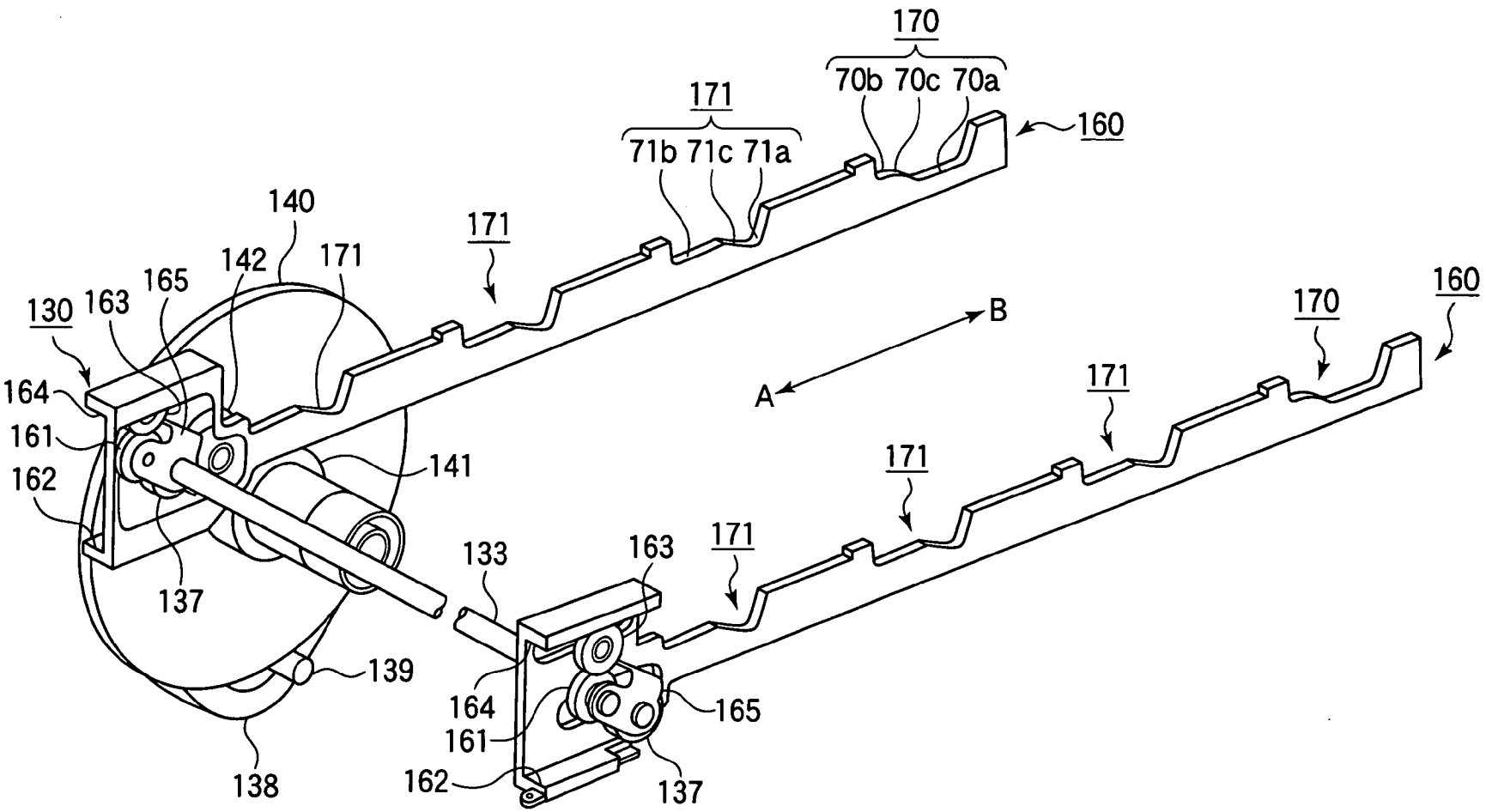
FIG. 13A is a perspective view of the up-down mechanism.

FIG. 13A is a perspective view of the up-down mechanism.

Figure 14:
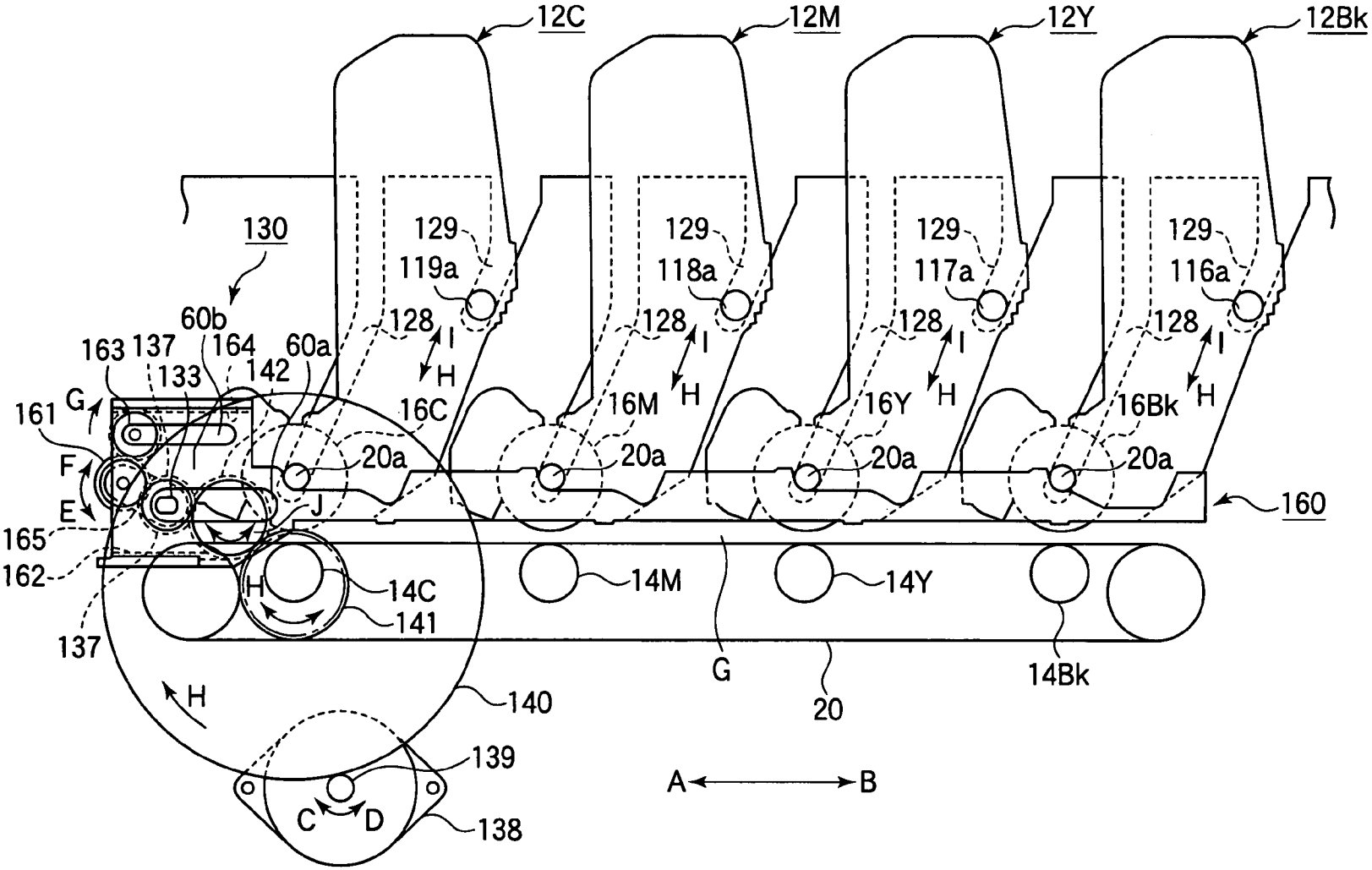
FIG. 14 illustrates the operation of the up-down mechanism.

FIG. 14 illustrates the operation of the up-down mechanism.

Referring to FIGS. 12–14, slide links 160 are movable in directions shown by arrows A and B. Each of the slide links 160 has elongated holes 60*a* and 60*b* that extends horizontally and are aligned vertically at a downstream end of the direction of travel of the recording medium 21. The slide links 160 each are formed with a guide surface 170 that opposes the black image forming section 12BK, and guide surfaces 171 that oppose the image forming sections 12Y, 12M, and 12C. The guide surface 170 includes a first (long) guide surface 70*a*, a second (short) guide surface 70*b* and an inclined surface 70*c* that is formed between the first and second guide surfaces 70*a* and 70*b* and is contiguous with the first and second guide surfaces 70*a* and 70*b*. The surface 70*b* is higher than the surface 70*a*. The guide surface 171 includes a third guide surface 71*a*, a fourth guide surface 71*b* and an inclined surface 71*c*. The guide surface 71*a* has the same height as the first (long) surface 70*a*. The long surface 70*a* extends longer in the longitudinal direction of the slide link than the second guide 70*b* and the guide surface 71*a*. The second guide surface 71*b* is longer than the third guide surface 71*a* and the second guide surface 70*b*.

The slide links 160 are moved in the directions shown by arrows A and B to predetermined positions, thereby supporting the shafts of the photoconductive drums 16BK, 16Y, 16M, and 16C in desired positions.

Figure 13B:
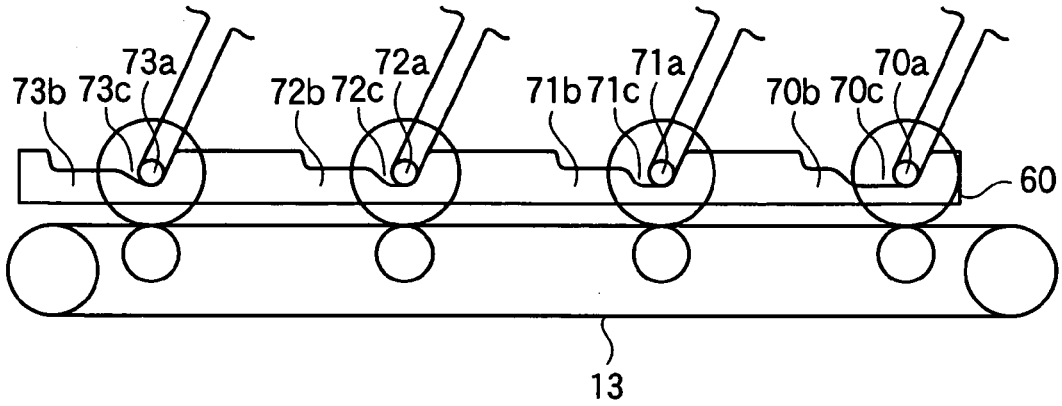
FIGS. 13B–13D illustrate the relationship between the positions of slide links and the upward and downward positions of image forming sections.
Figure 13C:
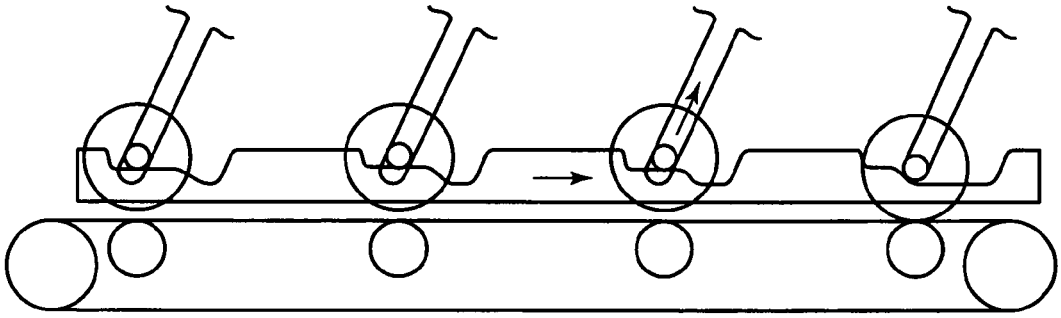
Figure 13D:
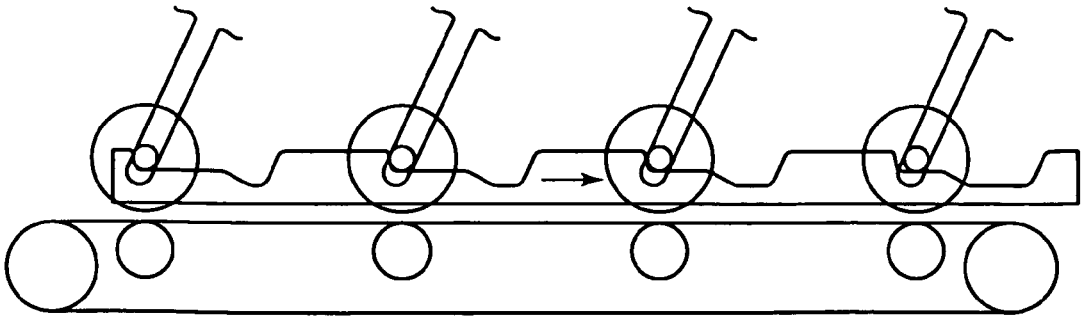

FIGS. 13B–13D illustrate the relationship between the positions of the slide links 160 and the upward and downward positions of the image forming sections 12BK, 12Y, 12M, and 12C.

FIG. 13B corresponds to FIG. 12 that shows the slide links 160 and the image forming sections 12BK, 12Y, 12M, and 12C when the slide links 160 have fully moved in a direction shown by arrow A. The image forming sections 12BK, 12Y, 12M, and 12C are at the operative position.

FIG. 13D corresponds to FIG. 14 that shows the slide links 160 and the image forming sections 12BK, 12Y, 12M, and 12C when the slide links 160 have fully moved in a direction shown by arrow B. The image forming sections 12BK, 12Y, 12M, and 12C are at the non-operative position.

FIG. 13C illustrates the slide links 160 and image forming sections 12BK, 12Y, 12M, and 12C when the slide links 160 are between the positions shown in FIG. 14B and FIG. 14D, in which only the image forming section 12BK is at the operative position.

FIG. 14 illustrates the image forming sections 12BK, 12Y, 12M, and 12C when they are at the non-operative position.

When the drive motor 138 rotates in a forward direction, a gear 139 rotates in a direction shown by arrow D, so that the gears 140–142 rotate in the directions shown by arrows H and J to cause the gears 137 to rotate in a direction shown by arrow E.

Each of the gears 137 is fixed to a longitudinal end of a rotating shaft 133 that extends through the elongated hole 60*a* and is movable along the elongated hole 60*a*. The rotating shaft 133 has a bracket 165 at each longitudinal end thereof. When the shaft 133 rotates, the bracket 165 rotates about the shaft 133 in directions shown by arrows E and F. The bracket 165 holds a planetary gear 161 rotatably, the planetary gear 161 being in mesh with the gear 137. When the bracket 165 is rotated in the E directions, the planetary gear 161 moves into meshing engagement with a rack 162 formed in a lower end portion of the slide link 160. When the bracket 165 is rotated in the F directions, the planetary gear 161 moves into meshing engagement with a gear 163 mounted on a shaft that extends through the elongated hole 60*b* and is movable along the elongated hole 60*b*. The gear 163 is in mesh with a rack 164 formed in an upper end portion of the slide link 160.

When the image forming sections 12BK, 12Y, 12M, and 12C are to move to the non-operative position, the drive motor 138 is driven to rotate in a reverse direction so that the gear 139 rotates in the D direction. Then, the bracket 165 rotates in the F direction, so that the planetary gear 161 and the gear 163 move into meshing engagement with each other to cause the gear 163 to rotate in a direction shown by arrow G. This causes the slide links 160 to slide in the B direction so that the shafts 20*a* of the photoconductive drums 16BK, 16Y, 16M, and 16C slide on the surfaces 170 and 171 to be supported on the second guide surfaces 70*b* and 71*b*.

As a result, the image forming sections 12BK, 12Y, 12M, and 12C move in directions shown by arrows I along guide grooves 128 formed in the printer body. Likewise, the shafts 116*a*–119*a* that project from side walls of the image forming sections 12BK, 12Y, 12M, and 12C move in directions shown by arrows I along guide grooves 129 formed in the printer body. This causes the image forming sections 12BK, 12Y, 12M, and 12C to move upward away from the transport belt 20.

When the image forming sections 12BK, 12Y, 12M, and 12C are raised until there is a gap G of several millimeters between the photoconductive drums and the transport belt 20, the drive motor 138 is stopped and then a holding current is supplied to the drive motor 138. The holding current maintains the image forming sections 12BK, 12Y, 12M, and 12C at the non-operative position.

When the image forming section 12BK is to move to the operative position and the image forming sections 12Y, 12M, and 12C are to move to the non-operative position, the drive motor 138 is rotated in the forward direction. The drive motor 138 causes the gear 139 to rotate in a direction shown by arrow C, so that the bracket 165 rotates in the E direction. This causes the planetary gear 161 to move into meshing engagement with the rack 162.

Thus, the slide links 160 are moved in the A direction. As a result, the shaft 20*a* of the photoconductive drum 16BK slides on the guide surface 170 until the shaft 20*a* is supported on the first guide surface 70*a*. Likewise, the shafts 20*a* of the photoconductive drums 16Y, 16M, and 16C slide on the guide surface 171 until the shafts 20*a* are supported on the their corresponding second surfaces 71*b*.

The image forming section 12BK moves downward along the guide groove 128 in the H direction and the shaft 116*a* moves downward along the guide 129 in the H direction, so that the image forming section 12BK moves toward the operative position.

Meanwhile, the image forming sections 12Y, 12M, and 12C move along the guide grooves 128 in the I directions and the shafts 117*a*, 118*a*, and 119*a* move along the guide groove 129 in the I directions, so that the image forming sections 12Y, 12M, and 12C move upward to the non-operative position.

When the photoconductive drum 16BK has moved into contact engagement with the transport belt 20, the drive motor 138 is stopped and then a holding current is supplied to the drive motor 138. The holding current maintains the image forming sections 12BK at the operative position and the image forming sections 12Y, 12M, and 12C at the non-operative position. Thus, black-and-white printing can be performed with the image forming section 12BK.

When the image forming sections 12BK, 12Y, 12M, and 12C are to move to the operative position, the drive motor 138 is driven to rotate further in the forward direction so that the gear 139 rotates in the C direction. The rotation of the gear 139 in the C direction causes the bracket 165 to rotate in the E direction, so that the planetary gear 161 moves into meshing engagement with the rack 162.

As a result, the slide links 160 slide further in the A direction, so that the shaft 20*a* of the photoconductive drum 16BK slides on the guide surface 170 until the shaft 20*a* is supported on the first (long) guide surface 70*a*. Likewise, the shafts 20*a* of the photoconductive drums 16Y, 16M, and 16C slide on the guide surface 171 until the shafts 20*a* are supported on the corresponding second (short) surfaces 71*a*.

The image forming sections 12BK, 12Y, 12M, and 12C moves along the guide groove 128 further in the H direction and the shafts 116*a*, 117*a*, 118*a*, and 119*a* move along the guide groove 129 in the H direction. As a result, the image forming sections 12BK, 12Y, 12M, and 12C move toward the operative position.

When the photoconductive drums 16BK, 16Y, 16M, and 16C have moved into contact engagement with the transport belt 20, the drive motor 138 is stopped and then a holding current is supplied to the drive motor 138. The holding current maintains the image forming sections 12BK, 12Y, 12M, and 12C at the operative position, so that the image forming sections are ready for color printing.

Figure 15A:
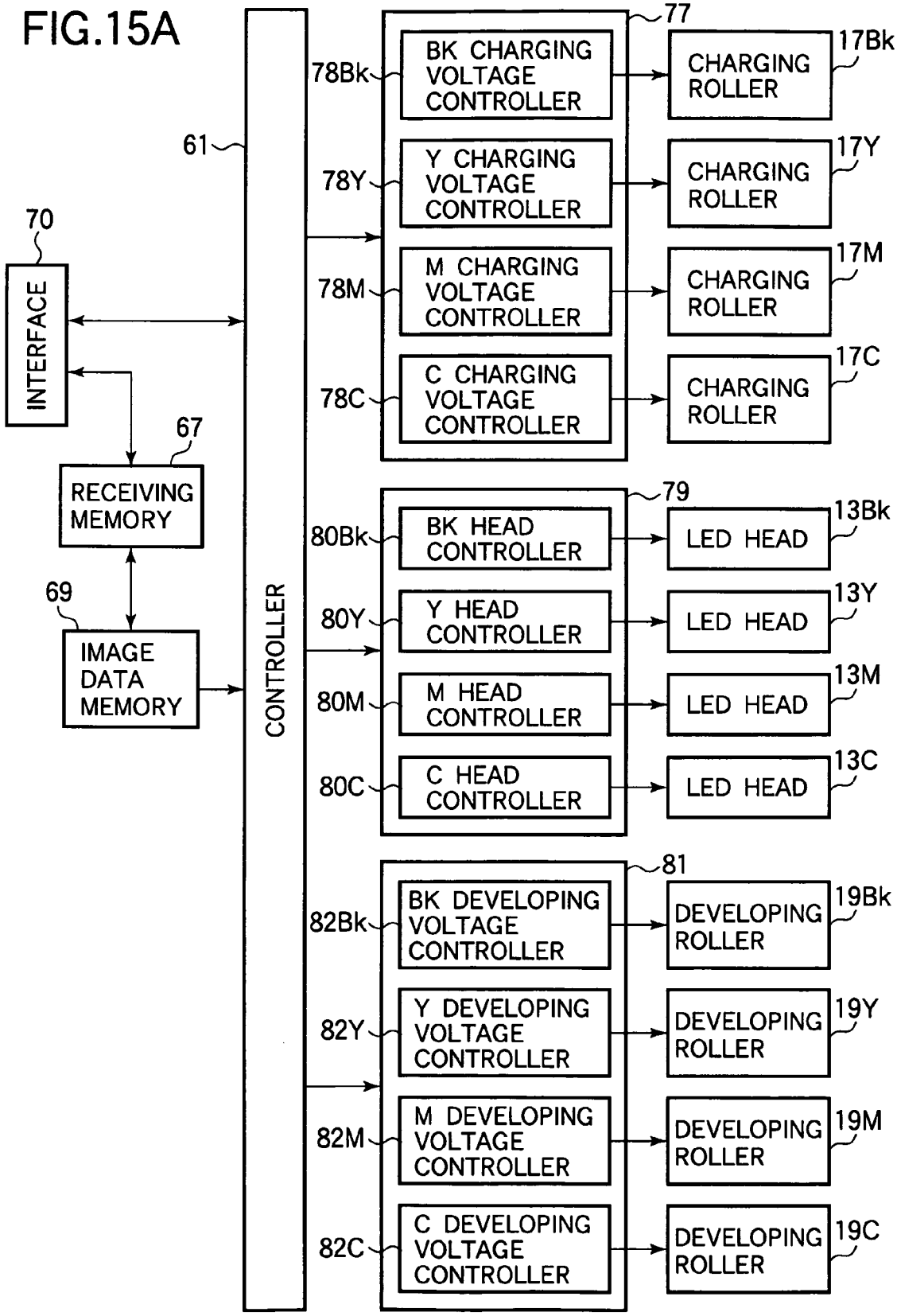
FIGS. 15A and 15B are block diagrams illustrating an overall control configuration of a printer according to a first embodiment illustrates the controller of the printer.
Figure 15B:
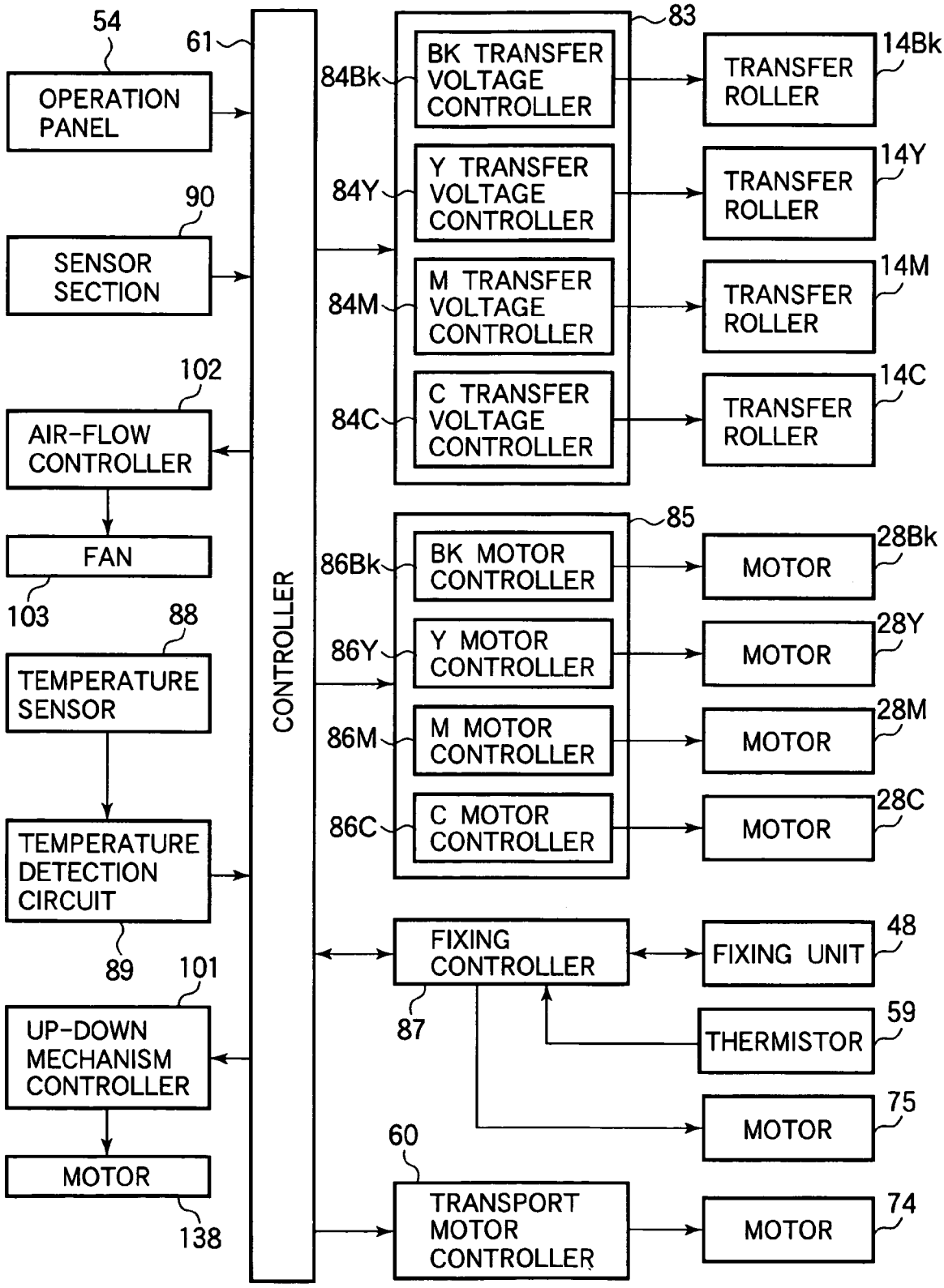

FIGS. 15A and 15B are block diagrams illustrating an overall configuration of a second embodiment. Most of the sections in the block diagrams operate in much the same way as those in the first embodiment and the description thereof is omitted.

The air-flow controller 102 causes the fan 103 to operate, thereby sucking air from the outside of the printer and causing the sucked air to flow through the gap G toward the fixing unit 48. The up-down mechanism controller 101 controls the drive motor 138 to drive the up-down mechanism 130 in FIGS. 12–14, thereby placing the image forming sections 12BK, 12Y, 12M, and 12C at the non-operative position.

In the present embodiment, repeating printing operations many times causes residual toner to adhere to the transport belt 20. Residual toner on the transport belt 20 agglomerates into large particles that cause damage to the surface of the photoconductive drums 16BK, 16Y, 16M, and 16C.

In the embodiment, the transport belt 20 can be driven to run with the image forming sections 12BK, 12Y, 12M, and 12C positioned at the non-operative position. The tip of a cleaning blade 34 disposed under the lower half of the transport belt 20 is configured to be in contact engagement with the transport belt 20. Then, the tip of the cleaning blade 34 scrapes the residual toner off the transport belt 20 into a waste toner reservoir 35.

Third Embodiment

Elements similar to those in the first embodiment have been given like reference numerals and the description thereof is omitted.

Figure 16:
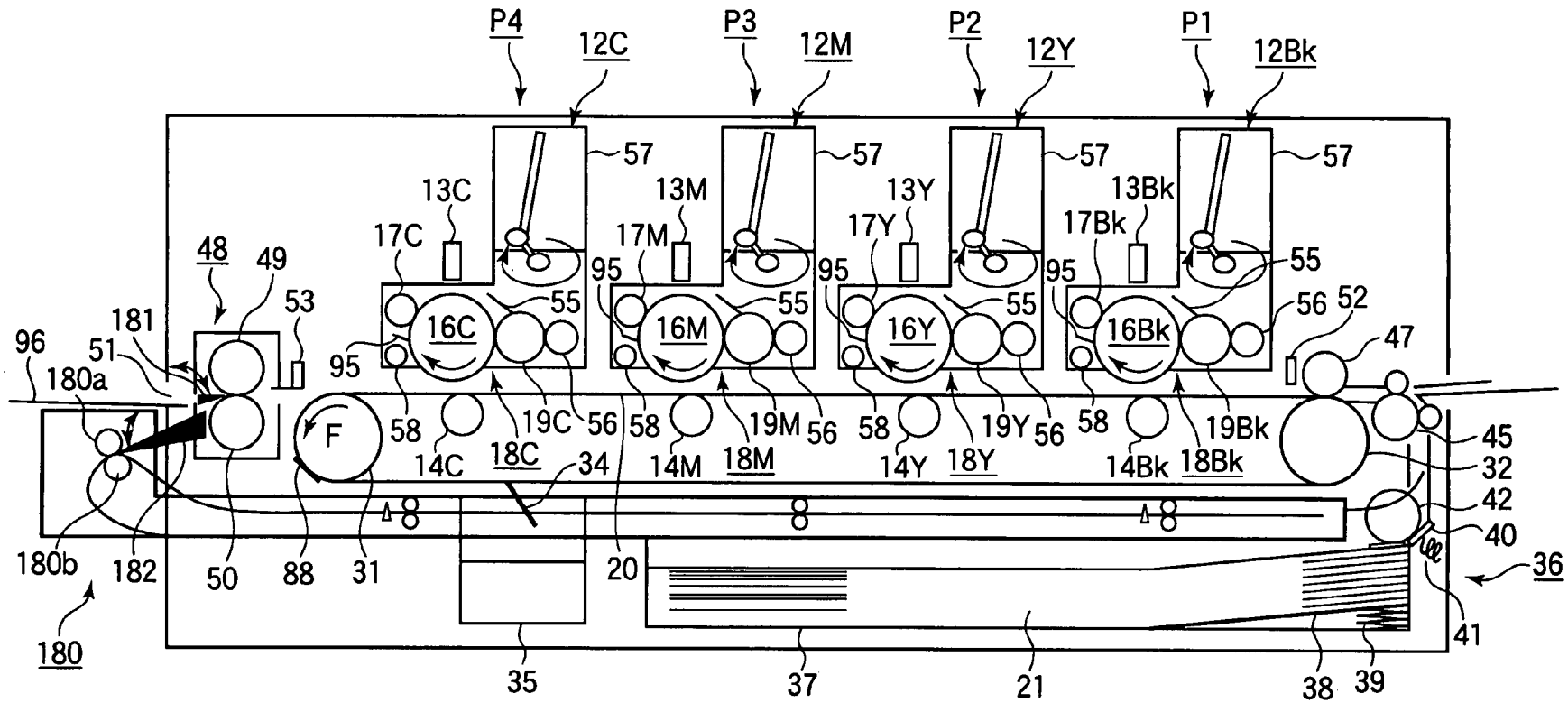
FIG. 16 is a side view in schematic form illustrating the a printer according to a third embodiment when the image forming sections are at the non-operative position.

FIG. 16 is a side view in schematic form illustrating a printer according to a third embodiment when the image forming sections are at the non-operative position.

Figure 17:
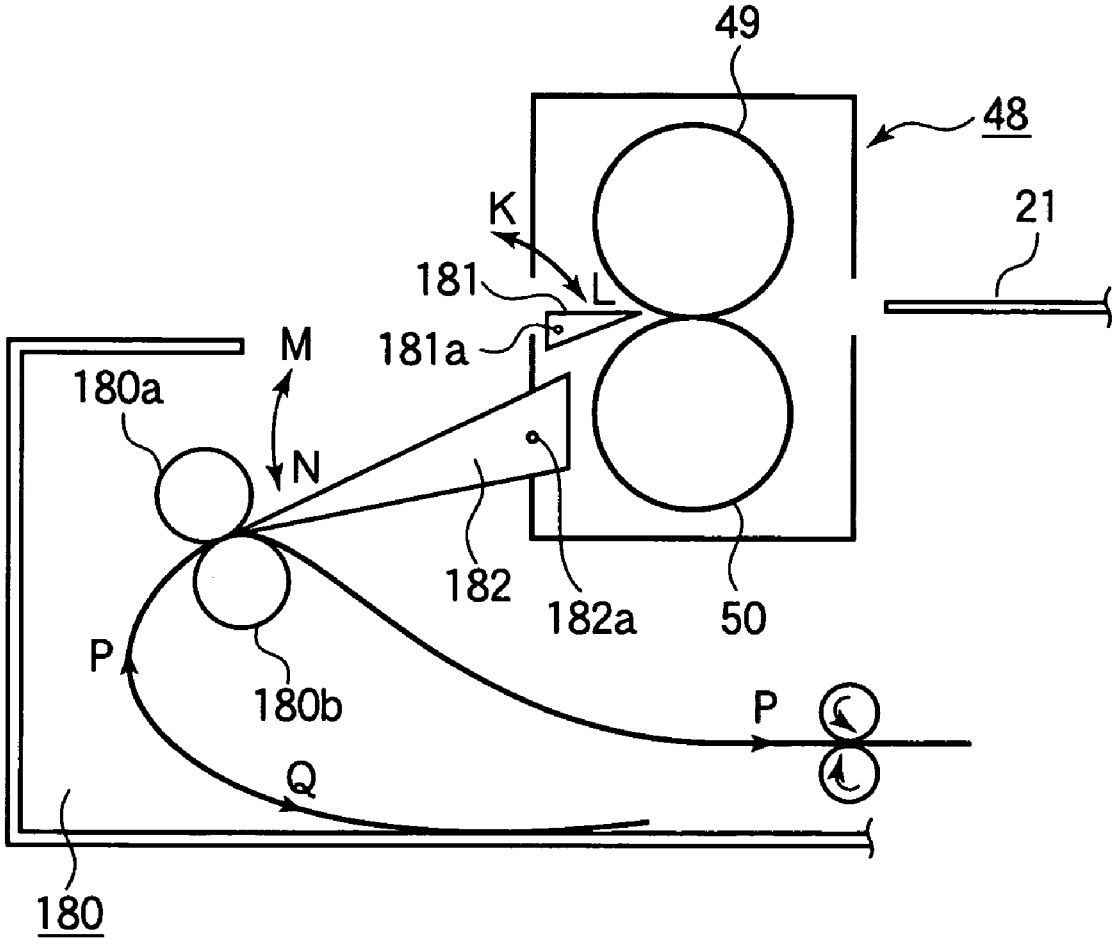
FIG. 17 is an enlarged view illustrating a pertinent portion of a path-switching unit.

FIG. 17 is an enlarged view illustrating a pertinent portion of a path-switching unit.

Figure 18:
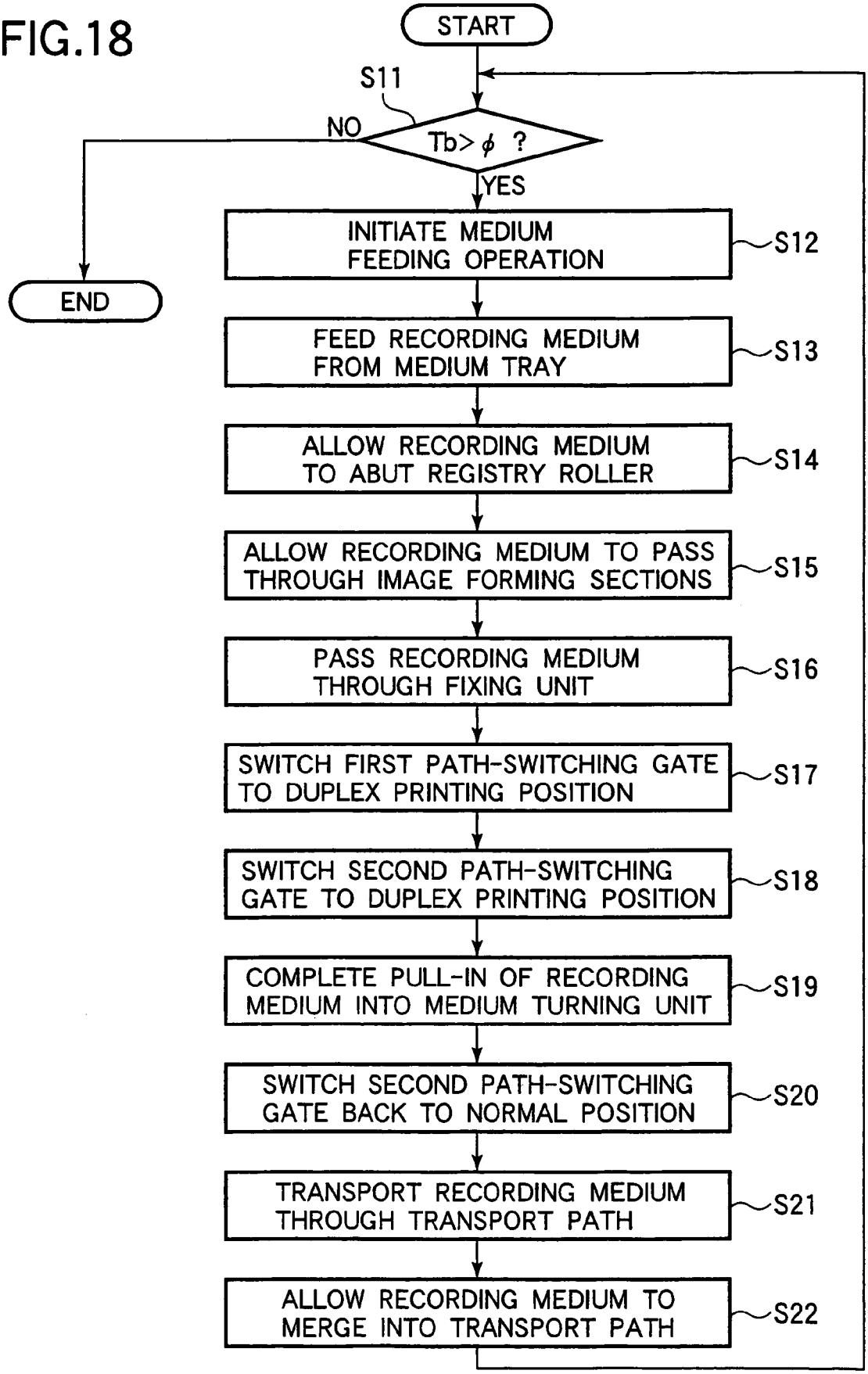
FIG. 18 is a flowchart illustrating the operation of the printer.

FIG. 18 is a flowchart illustrating the operation of the printer.

The printer incorporates a medium turning unit 180 detachably mounted. In the normal printing operation, after printing is performed on one side of a recording medium 21 the recording medium is fed into the medium-turning unit 180 where the recording medium 21 is turned over so that its underside becomes its top side. Thus, the recording medium is ready for subsequent printing on the other side of the recording medium 21. In the third embodiment, the medium-turning unit 180 is utilized to pass the recording medium 21 through the image forming sections to lower the surface temperature of the photoconductive drums 16BK, 16Y, 16M, and 16C.

In a cooling operation according to the third embodiment, the image forming sections are at the operative position, so that the non-printed recording medium 21 is advanced in contact with the photoconductive drums 16BK, 16Y, 16M, and 16C and the transfer rollers 14BK, 14Y, 14M, and 14C. Because the fixing unit 48 is located in a transport path, the recording medium 21 advances through the fixing unit 48 during the cooling operation.

In the third embodiment, when the heater of the fixing unit 48 remains turned off, the recording medium 21 is transported through the transport path, if the heat roller 49 and pressure roller 50 have been sufficiently cooled. Alternatively, when the heater of the fixing unit 48 remains turned off, the recording medium 21 is transported through the transport path if the temperature of the heat roller 49 is being controlled to a lower temperature in the cooling operation than in the normal printing operation.

The operation of the aforementioned printer will be described.

When a printing operation is activated, the controller 61 determines whether the detected temperature Tb is higher than the threshold $\phi$ (e.g., 50° C. in the third embodiment). If $Tb>\phi$, the controller 61 performs the cooling operation. The recording medium 21 is fed from the medium tray 37. The recording medium 21 is used as a cooling medium for cooling the photoconductive drums.

The recording medium 21 fed from the medium tray 37 first abuts the registry roller 45 and then advances through the image forming sections 12BK, 12Y, 12M, and 12C and then through the fixing unit 48. The image forming sections are at the operative position but no image is formed in each image forming section and the heater of the fixing unit 48 remains off or controlled at a lower temperature in the cooling operation than in the normal printing operation.

A first path-switching gate 181 is pivotally disposed between the fixing unit 48 and the stacker 96. Referring to FIG. 17, the first path-switching gate 181 is pivoted counter clockwise (arrow K) about a pin 181*a* to a duplex printing position and a second path-switching gate 182 is pivoted clockwise (arrow N) about a pin 182*a* to a duplex printing position. Thus, the recording medium 21 exiting the fixing unit is pulled in between rollers 180*a* and 180*b* into the medium-turning unit 180 and advances in a direction shown by arrow Q.

Then, the second path-switching gate 182 is then pivoted clockwise (arrow M) and the rollers 180*a* and 180*b* rotate in a reverse direction so that the recording medium 21 is pulled into the medium-turning unit 180 and then moved backward in a direction shown by arrow P. In this manner, the recording medium 21 is turned over and transported through the medium-turning unit 180 toward the transport path of the medium feeding mechanism 36.

In this manner, the same page of recording medium is repeatedly passed through the image forming sections to absorb heat radiated from the photoconductive drums 16BK, 16Y, 16M, and 16C. The length of a transport path determines a maximum number of pages of the recording medium 21 that occupies the transport path when the pages of the recording medium 21 advance in succession. In the third embodiment, the maximum number of pages of the recording medium 21 is three.

When the normal printing is performed, the first path-switching gate 181 is pivoted clockwise (arrow L) about the pin 181*a* to a simplex printing position and the second path-switching gate 182 is pivoted clockwise (arrow M) about the pin 182*a* to a simplex printing position. The recording medium 21 is advanced straightly through the exit from the fixing unit 48.

The operation of the medium feeding mechanism 36 and the medium-turning unit 180 can be controlled under the control of separate control programs. In the third embodiment, however, the medium feeding mechanism 36 and the medium-turning unit 180 are controlled under the control of the same control program, thereby simplifying the control of the printer. Therefore, the cooling operation includes the control of the transport speed of the recording medium 21, and the control of registry of the recording medium 21, which are essential in the normal printing operation and not in the cooling operation.

When the detected temperature Tb is below the threshold $\phi$, the controller 61 terminates the cooling operation and causes the medium feeding mechanism 36 to stop feeding. The recording medium 21 may be discharged from the apparatus shortly after the cooling operation or may be printed upon a print command subsequent to a cooling operation.

The flowchart will be described.

Step S11: A check is made to determine whether $Tb>\phi 1$. If $Tb>\phi 1$, the program proceeds to step S12; if $Tb\leqq\phi 1$, then the program terminates the operation.

Step S12: The controller 61 initiates a medium feeding operation.

Step S13: The recording medium 21 is fed from the medium tray 37.

Step S14: The recording medium 21 abuts the registry roller 45.

Step S15: The recording medium 21 passes through the image forming sections 12BK, 12Y, 12M, and 12C.

Step S16: The recording medium 21 passes the fixing unit 48.

Step S17: The first path-switching gate 181 is switched to the duplex printing position.

Step S18: The second path-switching gate 182 is switched to the duplex printing position.

Step S19: The recording medium 21 is completely pulled into the medium turning unit 180.

Step S20: The second path-switching gate 182 is switched back to the normal printing position.

Step S21: The recording medium 21 advances through the transport path.

Step S22: The recording medium 21 is merged into the transport path. The program jumps back to Step S11.

While the fixing unit according to the present invention includes two rollers, both of the two rollers or one of the rollers may be replaced by a refractory belt so that the recording medium is held sandwiched between the roller and the belt or between the belts. The present invention has been described with respect to the transport belt 20 that transports the recording medium 21 by way of example. The present invention may also be applied to an intermediate transfer method in which a visible image (e.g., toner image) is transferred onto an intermediate transfer belt and then the visible image on the belt is transferred onto a recording medium. While the respective embodiments have been described with respect to a color printer, the present invention may also be applied to a monochrome printer. The present invention is not limited to the aforementioned embodiments but may be modified in any way within the scope of the accompanying claims.

What is claimed is:

1. An image forming apparatus comprising:

a plurality of image forming sections in which an electrostatic latent image is formed on a charged surface of an image bearing body and developed with toner into a visible image;

a transfer section that transfers the visible image onto a recording medium;

a fixing unit that fixes the visible image on the recording medium;

a temperature detecting section disposed in an area between said fixing unit and a one of said plurality of image forming sections closest to said fixing unit, said temperature detecting section not being in contact with said fixing unit, said temperature detecting section outputting a signal indicative of a temperature of a predetermined part of the image forming apparatus; and a controller adapted to perform a cooling operation in which the temperature of the image bearing body is lowered when the signal is higher than a first predetermined value.

2. The image forming apparatus according to claim 1, wherein during the cooling operation, said controller controllably energizes a heater of said fixing unit for a predetermined fixing temperature.

3. The image forming apparatus according to claim 2, wherein said controller stops energizing the heater of said fixing unit during the cooling operation.

4. The image forming apparatus according to claim 2, wherein when the controller performs the cooling operation, said controller turns on and off the heater of said fixing unit with a first duty cycle;

wherein when the controller does not perform the cooling operation, said controller turns on and off the heater of said fixing unit with a second duty cycle higher than the first duty cycle.

5. An image forming apparatus comprising:

an image forming section in which an electrostatic latent image is formed on a charged surface of an image bearing body and developed with toner into a visible image;

a transfer section that transfers the visible image onto a recording medium;

a fixing unit that fixes the visible image on the recording medium;

a temperature detecting section that outputs a signal indicative of a temperature of a predetermined part of the image forming apparatus; and a controller adapted to perform a cooling operation in which the temperature of the image bearing body is lowered when the signal is higher than a first predetermined value;

wherein during the cooling operation, said controller drives a medium-transporting mechanism of said fixing unit to rotate in an idling mode in which no printing is performed.

6. The image forming apparatus according to claim 5, wherein the said controller causes the medium-transporting mechanism to rotate at a higher speed in the cooling operation than in a normal printing operation.

7. An image forming apparatus comprising:

an image forming section in which an electrostatic latent image is formed on a charged surface of an image bearing body and developed with toner into a visible image;

a transfer section that transfers the visible image onto a recording medium;

a fixing unit that fixes the visible image on the recording medium;

a temperature detecting section that outputs a signal indicative of a temperature of a predetermined part of the image forming apparatus;

a controller adapted to perform a cooling operation in which the temperature of the image bearing body is lowered when the signal is higher than a first predetermined value; and a belt adapted to rotate in contact with the image bearing body;

wherein during the cooling operation, said controller drives the belt and the image bearing body to rotate in an idling mode in which no printing is performed.

8. The image forming apparatus according to claim 7, wherein said controller drives the belt and the image bearing body to rotate at a higher speed in the cooling operation than in a normal printing operation.

9. The image forming apparatus according to claim 7, wherein the temperature detecting section detects a temperature of the belt.

10. The image forming apparatus according to claim 7, wherein said image forming section is movable between an operative position at which the image bearing body is in contact with the belt and a non-operative position at which the image bearing body is not in contact with the belt;

wherein said controller causes said image forming section to move to the non-operative position when the cooling operation is activated.

11. The image forming apparatus according to claim 10, wherein during the cooling operation, said controller causes air to flow through a gap between said image forming section and the belt.

12. An image forming apparatus comprising:

an image forming section in which an electrostatic latent image is formed on a charged surface of an image bearing body and developed with toner into a visible image;

a transfer section that transfers the visible image onto a recording medium;

a fixing unit that fixes the visible image on the recording medium;

a temperature detecting section that outputs a signal indicative of a temperature of a predetermined part of the image forming apparatus;

a controller adapted to perform a cooling operation in which the temperature of the image bearing body is lowered when the signal is higher than a first predetermined value; and a medium turning mechanism in which when the recording medium exits said fixing unit, the recording medium is turned over so that its under side becomes its top side;

wherein during the cooling operation, said controller causes the recording medium to pass through the medium turning mechanism in such a way that a same page of the recording medium passes under said image forming section a plurality of times but is not printed on.

13. The image forming apparatus according to claim 12, wherein the page of the recording medium is printed upon a print command subsequent to the cooling operation.

14. The image forming apparatus according to claim 12, wherein the page of the recording medium is discharged from the apparatus after the cooling operation.

15. The image forming apparatus according to claim 1, wherein said controller performs the cooling operation when the signal exceeds a threshold temperature, wherein the threshold temperature is adapted to be set to a desired value.

16. The image forming apparatus according to claim 1, wherein before each page of the recording medium is printed on, said controller determines whether the cooling operation should be performed.

17. The image forming apparatus according to claim 1, wherein upon receiving a print job, said controller determines whether the cooling operation should be performed.

18. The image forming apparatus according to claim 1, wherein said controller terminates the cooling operation after the cooling operation is performed for a predetermined length of time.

19. The image forming apparatus according to claim 1, wherein said controller terminates the cooling operation when the signal is below a second predetermined value.

20. The image forming apparatus according to claim 1, wherein said temperature detecting section is located in the vicinity of the image bearing body to detect a temperature of an atmosphere surrounding the image bearing body, the signal indicating substantially the temperature of the image bearing body.

* * * * *